US010175637B2

(12) United States Patent
Nishiyama et al.

(10) Patent No.: US 10,175,637 B2
(45) Date of Patent: Jan. 8, 2019

(54) DEVELOPING CARTRIDGE HAVING CONTACT SURFACE

(71) Applicant: BROTHER KOGYO KABUSHIKI KAISHA, Nagoya-shi, Aichi-ken (JP)

(72) Inventors: Hideshi Nishiyama, Owariasahi (JP); Nao Itabashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,694

(22) Filed: Sep. 29, 2017

(65) Prior Publication Data

US 2018/0095416 A1 Apr. 5, 2018

(30) Foreign Application Priority Data

Sep. 30, 2016 (JP) ..... 2016-193691
Jan. 16, 2017 (JP) ..... 2017-005064

(51) Int. Cl.
*G03G 15/08* (2006.01)
*G03G 21/16* (2006.01)

(52) U.S. Cl.
CPC ..... *G03G 21/1652* (2013.01); *G03G 15/0863* (2013.01); *G03G 15/0865* (2013.01); *G03G 21/1676* (2013.01); *G03G 15/0896* (2013.01)

(58) Field of Classification Search
CPC ..... G03G 15/0863; G03G 15/0865; G03G 15/0896; G03G 21/1647; G03G 21/1652;
(Continued)

(56) References Cited

U.S. PATENT DOCUMENTS

2007/0059018 A1 3/2007 Tokuda
2009/0003875 A1 1/2009 Toba et al.
(Continued)

FOREIGN PATENT DOCUMENTS

EP 1 363 168 A2 11/2003
JP 2003-195726 A 7/2003
(Continued)

OTHER PUBLICATIONS

Extended European Search Report issued in related European Patent Application No. 17193927.5, dated Feb. 3, 2018.
(Continued)

*Primary Examiner* — Sophia S Chen
(74) *Attorney, Agent, or Firm* — Merchant & Gould P.C.

(57) ABSTRACT

A developing cartridge includes a housing, a developing roller, a lever, and a storage medium. The housing may be configured to store a developing agent. The developing roller may be rotatable about a first axis extending in a first direction. The storage medium may be swingable together with the lever in a swing direction. The storage medium may have an electric contact surface. The electric contact surface may be swingable between a retreat position and an advance position. The electric contact surface may be positioned at the retreat position when the lever is positioned at a first position. The electric contact surface may be positioned at the advance position in a case where the lever is positioned at a second position. The housing may be movable in the second direction relative to the lever and the electric contact surface in a case where the electric contact surface is positioned at the advance position.

25 Claims, 24 Drawing Sheets

(58) Field of Classification Search
CPC ..... G03G 21/1676; G03G 21/1875; G03G 21/1878; G03G 2215/0695; G03G 2221/163; G03G 2221/1823
See application file for complete search history.

(56) References Cited

U.S. PATENT DOCUMENTS

| | | | | |
|---|---|---|---|---|
| 2009/0196647 | A1 | 8/2009 | Nishimoto | |
| 2011/0064457 | A1 | 3/2011 | Okabe et al. | |
| 2011/0129252 | A1 | 6/2011 | Oda et al. | |
| 2013/0051849 | A1 | 2/2013 | Itabashi et al. | |
| 2013/0183058 | A1 | 7/2013 | Won | |
| 2015/0037059 | A1 | 2/2015 | Yang et al. | |
| 2015/0212482 | A1* | 7/2015 | Wakimoto ..... | G03G 21/1676 399/90 |
| 2015/0261171 | A1 | 9/2015 | Moon et al. | |

FOREIGN PATENT DOCUMENTS

| | | | |
|---|---|---|---|
| JP | 2007-017774 | A | 1/2007 |
| JP | 2009-211054 | A | 9/2009 |
| JP | 2011059510 | A | 3/2011 |
| JP | 2011-118119 | A | 6/2011 |
| JP | 2013054058 | A | 3/2013 |
| JP | 3196279 | U | 3/2015 |

OTHER PUBLICATIONS

International Search Report and the Written Opinion issued in related International Application No. PCT/JP2017/035541, dated Dec. 5, 2017.

* cited by examiner

DEVELOPING CARTRIDGE HAVING CONTACT SURFACE

CROSS REFERENCE TO RELATED APPLICATION

This application claims priority from Japanese Patent Applications No. 2016-193691 filed Sep. 30, 2016 and No. 2017-005064 filed Jan. 16, 2017. The entire content of the priority applications are incorporated herein by reference.

TECHNICAL FIELD

The present disclosure relates to a developing cartridge having an electric contact surface.

BACKGROUND

There is known an electrophotographic image forming apparatus such as a laser printer or an LED printer. Such an image forming apparatus uses a developing cartridge. The developing cartridge includes a developing roller for supplying toner. The developing cartridge known in the prior art is inserted relative to a drawer unit. The drawer unit includes a photosensitive drum. In a case where the developing cartridge is inserted relative to the drawer unit, the photosensitive drum and developing cartridge face each other. Then, the drawer unit attached to the developing cartridge is accommodated inside the image forming apparatus.

Another developing cartridge known in the prior art is inserted relative to a drum unit. The drum unit includes a photosensitive drum. In a case where the developing cartridge is inserted relative to the drum unit, the photosensitive drum and developing cartridge face each other. Then, the drum unit attached to the developing cartridge is attached to the image forming apparatus.

SUMMARY

There is also known a developing cartridge including a storage medium. The storage medium is, e.g., an IC chip. The storage medium includes an electric contact surface. The electric contact surface is in contact with a terminal of the image forming apparatus or the drawer unit. However, the terminal and electric contact surface may rub against each other in a state where the developing cartridge is inserted relative to the image forming apparatus or drawer unit.

The object of the present disclosure is to provide a configuration capable of reducing rubbing of the electric contact surface at insertion of the developing cartridge.

According to one aspect, the disclosure provides a developing cartridge including a housing, a developing roller, a lever, and a storage medium. The housing may be configured to store a developing agent. The developing roller may be rotatable about a first axis extending in a first direction. The developing roller may be positioned at one end portion of the housing in a second direction. The lever may be swingable between a first position and a second position about a second axis extending in the first direction. The storage medium may be swingable together with the lever in a swing direction. The storage medium may include an electric contact surface crossing the swing direction. The electric contact surface may be swingable between a retreat position and an advance position. The electric contact surface may be positioned at the retreat position in a case where the lever is positioned at the first position. The electric contact surface may be positioned at the advance position in a case where the lever is positioned at the second position. The housing may be movable in the second direction relative to the lever and the electric contact surface in a case where the electric contact surface is positioned at the advance position.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
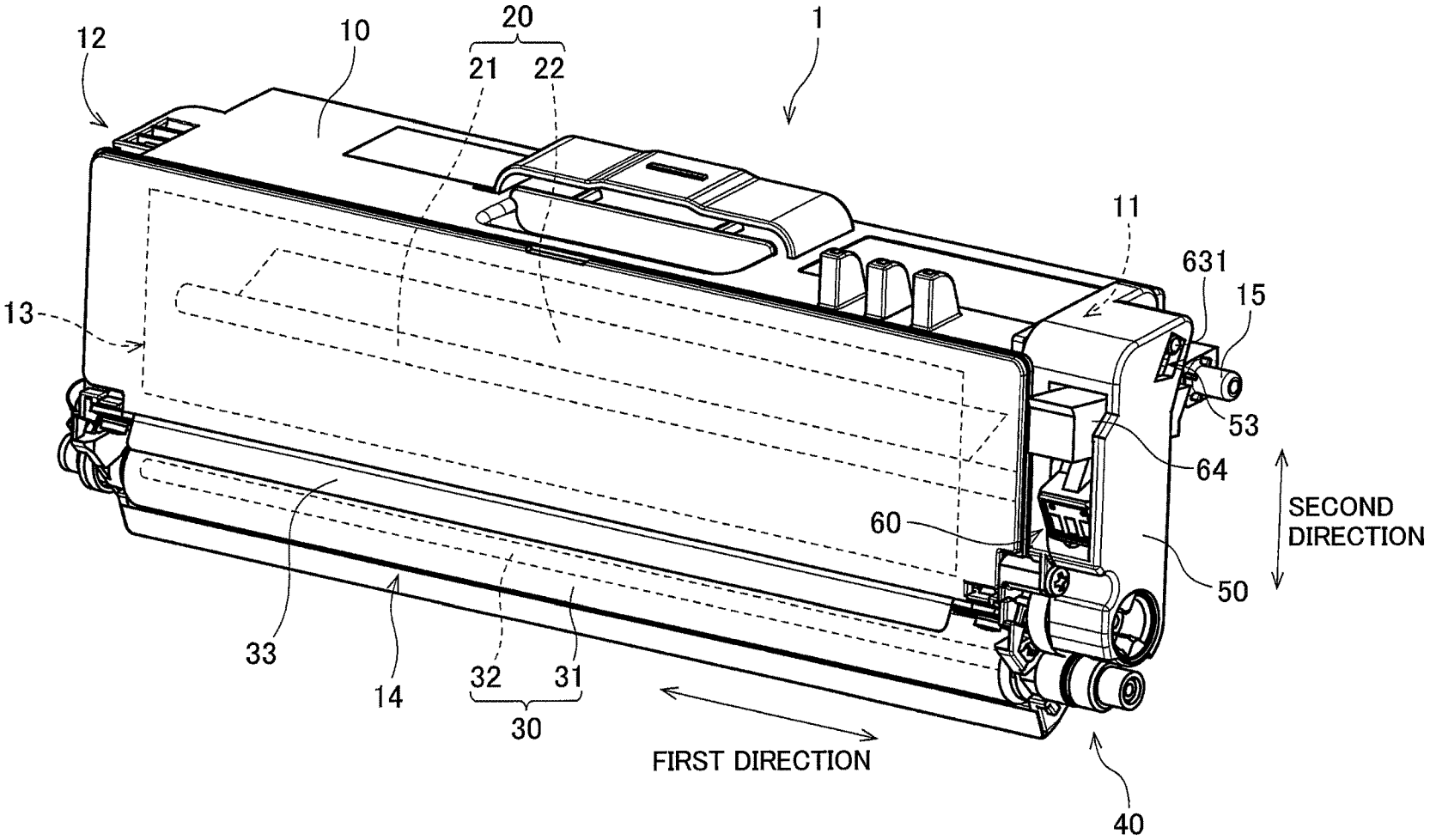
FIG. 1 is a perspective view of a developing cartridge according to an embodiment.

A developing cartridge according to an embodiment will be described while referring to the accompanying drawings wherein like parts and components are designated by the same reference numerals to avoid duplicating description.

An embodiment and modifications of the present disclosure will be described below with reference to the accompanying drawings.

Hereinafter, the direction in which the rotation axis of a developing roller extends is referred to as "first direction". The direction in which a casing moves during separating operation is referred to as "second direction". The direction crossing an electric contact surface is referred to as "third direction". The first and second directions cross each other, preferably, are perpendicular to each other. The second and third directions cross each other, preferably, are perpendicular to each other. The third and first directions cross each other, preferably, are perpendicular to each other.

<1. Entire Configuration of Developing Cartridge>

Figure 2:
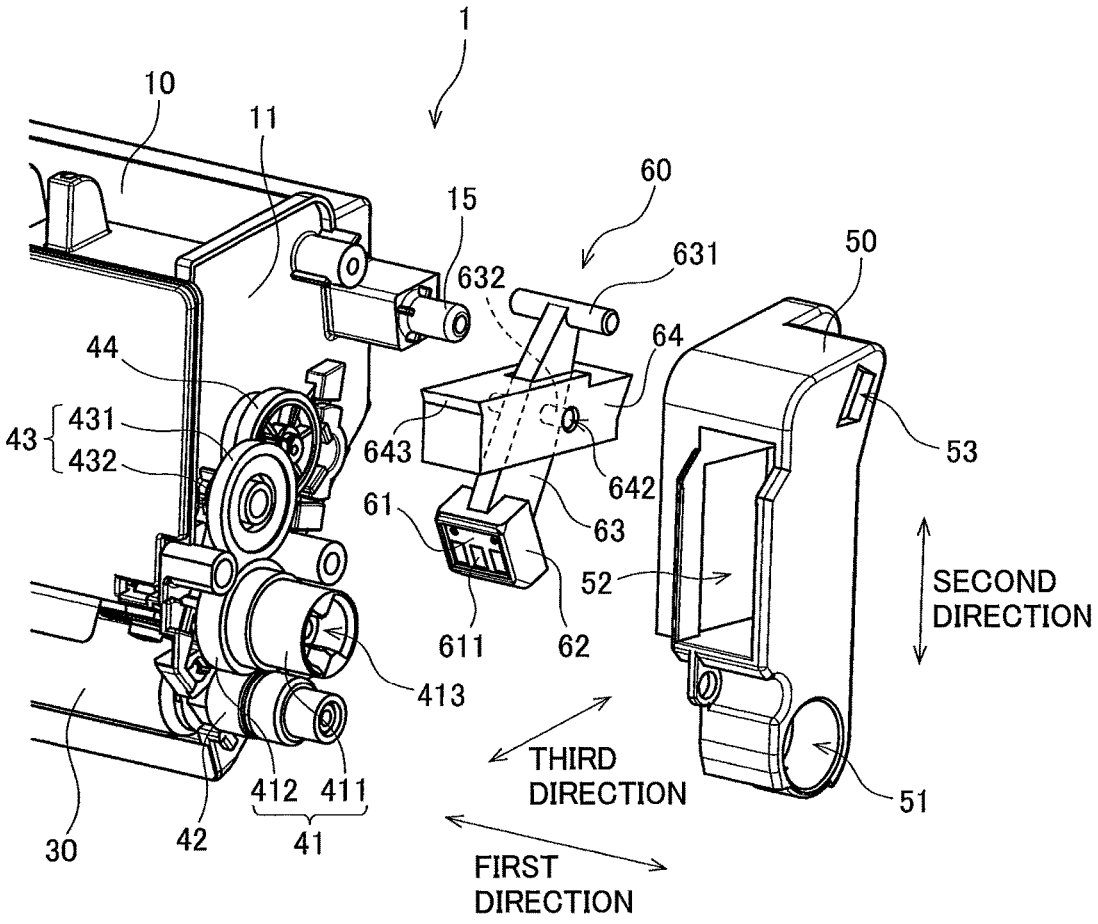
FIG. 2 is a partially exploded perspective view of the developing cartridge according to the embodiment.

FIG. 1 is a perspective view of a developing cartridge 1 as an example of the present disclosure. FIG. 2 is a partially exploded perspective view of the developing cartridge 1. The developing cartridge 1 is used in an electrophotographic image forming apparatus (e.g., a laser printer, or an LED printer) and is configured to supply a developing agent (e.g., toner) to a photosensitive drum. The developing cartridge 1 is attached to a drawer unit 9 included in the image forming apparatus. When exchanging the developing cartridge 1, the drawer unit 9 is pulled out from the front surface of the image forming apparatus. Then, the developing cartridge 1 is inserted in each of a plurality of slots of the drawer unit 9. A photosensitive drum is set in each of the plurality of slots.

Alternatively, the developing cartridge 1 may be attached to the body portion of the image forming apparatus. In this case, the developing cartridge 1 is inserted in each of a plurality of slots of the image forming apparatus. A photosensitive drum is set in each of the plurality of slots. Further alternatively, the developing cartridge 1 may be attached to a drum unit detachably attached to the image forming apparatus. In this case, the drum unit includes a photosensitive drum. The developing cartridge 1 is attached to the drum unit, and the drum unit attached to the developing cartridge 1 is inserted in a slot of the image forming apparatus.

As illustrated in FIG. 1, the developing cartridge 1 according to the present embodiment includes a casing 10, an agitator 20, a developing roller 30, a gear portion 40, a cover 50, and an IC chip assembly 60.

The casing 10 is a housing configured to store the developing agent therein. The casing 10 extends in the first direction between a first outer surface 11 and a second outer surface 12. The gear portion 40, cover 50, and IC chip assembly 60 are positioned at the first outer surface 11. A container 13 is positioned inside the casing 10. The developing agent is stored in the container 13. The casing 10 has an opening 14. The opening 14 is positioned at one end portion of the casing 10 in the second direction. The container 13 communicates with the outside thereof through the opening 14.

The agitator 20 includes an agitator shaft 21 and an agitation blade 22. The agitator shaft 21 is rotatable about the rotation axis extending in the first direction. The agitation blade 22 extends outward from the agitator shaft 21 in the radial direction. At least a portion of the agitator shaft 21 and the entire agitation blade 22 are positioned inside the container 13. One end portion of the agitator shaft 21 in the first direction is fixed to an agitator gear 44 to be described later so as to be relatively non-rotatable. Therefore, the agitator shaft 21 and agitation blade 22 are rotatable together with the agitator gear 44. In a case where the agitation blade 22 rotates, the developing agent in the container 13 is agitated.

The developing roller 30 is rotatable about the rotation axis (first axis) extending in the first direction. The developing roller 30 is positioned at the opening 14 of the casing 10. That is, the developing roller 30 is positioned at one end portion of the casing 10 in the second direction. The developing roller 30 in the present embodiment includes a developing roller body 31 and a developing roller shaft 32. The developing roller body 31 is a cylindrical member extending in the first direction. As a material for the developing roller body 31, rubber having elasticity is used. The developing roller shaft 32 is a columnar member penetrating the developing roller body 31 in the first direction. As a material for the developing roller shaft 32, metal or resin having electric conductivity is used. The developing roller body 31 is fixed to the developing roller shaft 32 so as to be relatively non-rotatable.

A developing roller gear 42 is mounted to one end portion of the developing roller shaft 32 in the first direction. More in detail, the one end portion of the developing roller shaft 32 in the first direction is fixed to the developing roller gear 42 so that one end portion of the developing roller shaft 32 is not rotatable relative to the developing roller gear 42. Thus, in a case where the developing roller gear 42 rotates, the developing roller shaft 32 rotates, so that the developing roller body 31 rotates together with the developing roller shaft 32.

The developing roller shaft 32 may not necessarily penetrate the developing roller body 31 in the first direction. For example, a pair of developing roller shafts 32 may extend from opposite ends of the developing roller body 31 in the first direction.

The developing cartridge 1 includes an unillustrated supply roller. The supply roller is positioned between the developing roller 30 and the container 13. Further, the supply roller is rotatable about the rotation axis extending in the first direction. In a case where the developing cartridge 1 receives drive force, the developing agent is supplied from the container 13 inside the casing 10 to the outer peripheral surface of the developing roller 30 through the supply roller. At this time, the developing agent is friction-charged between the supply roller and the developing roller 30. On the other hand, bias voltage is applied to the developing roller shaft 32 of the developing roller 30. Therefore, the developing agent is attracted to the outer peripheral surface of the developing roller body 31 by electrostatic force between the developing roller shaft 32 and the developing agent.

Further, the developing cartridge 1 includes a layer thickness regulation blade 33. The layer thickness regulation blade 33 regulates the thickness of the developing agent supplied to the outer peripheral surface of the developing roller body 31 to a constant thickness. The developing agent on the outer peripheral surface of the developing roller body 31 is supplied to a photosensitive drum in the drawer unit 9. At this time, the developing agent is moved to the photosensitive drum from the developing roller body 31 based on an electrostatic latent image formed on the outer peripheral surface of the photosensitive drum. As a result, the electrostatic latent image is visualized on the outer peripheral surface of the photosensitive drum.

The gear portion 40 is positioned at the first outer surface 11 of the casing 10. As illustrated in FIG. 2, the gear portion 40 includes a coupling 41, a developing roller gear 42, an idle gear 43, and an agitator gear 44. In FIG. 2, illustration of a plurality of gear teeth of each gear is omitted.

The coupling 41 is a gear that configured to receive drive force first from the image forming apparatus. The coupling 41 is rotatable about the rotation axis extending in the first direction. The coupling 41 includes a coupling portion 411 and a coupling gear 412. The coupling portion 411 and coupling gear 412 are integrally made from, e.g., resin. The coupling portion 411 has a fastening hole 413 recessed in the first direction. Further, a plurality of gear teeth are provided at equal intervals over the entire outer peripheral portion of the coupling gear 412.

In a case where the drawer unit 9 attached to the developing cartridge 1 is inserted inside the image forming apparatus, a drive shaft of the image forming apparatus is inserted in the fastening hole 413 of the coupling portion 411. As a result, the drive shaft and coupling portion 411 are connected such that the drive shaft is not rotatable relative to the coupling portion 411. Thus, rotation of the drive shaft rotates the coupling portion 411, so that the coupling gear 412 rotates together with the coupling portion 411.

The developing roller gear 42 is configured to rotate the developing roller 30. The developing roller gear 42 is rotatable about the rotation axis extending in the first direction. A plurality of gear teeth are provided at equal intervals over the entire outer peripheral portion of the developing roller gear 42. Some of the plurality of gear teeth of the coupling gear 412 and some of the plurality of gear teeth of the developing roller gear 42 mesh with each other. The developing roller gear 42 is fixed to the end portion of the developing roller shaft 32 in the first direction so as to be relatively non-rotatable. Thus, in a case where the coupling gear 412 rotates, the developing roller gear 42 rotates, so that the developing roller 30 rotates together with the developing roller gear 42.

The idle gear 43 is configured to transmit rotation of the coupling gear 412 to the agitator gear 44. The idle gear 43 is rotatable about the rotation axis extending in the first direction. The idle gear 43 includes a large diameter portion 431 and a small diameter portion 432 which are arranged in the first direction. The small diameter portion 432 is positioned between the large diameter portion 431 and the first outer surface 11 of the casing 10. In other words, the large diameter portion 431 is farther away from the first outer surface 11 than the small diameter portion 432. The tooth tip circle diameter of the small diameter portion 432 is smaller than the tooth tip circle diameter of the large diameter portion 431. The large diameter portion 431 and small diameter portion 432 are integrally made from, e.g., resin.

A plurality of gear teeth are provided at equal intervals over the outer peripheral portion of each of the large diameter portion 431 and small diameter portion 432. The number of gear teeth of the small diameter portion 432 is smaller than the number of gear teeth of the large diameter portion 431. Some of the plurality of gear teeth of the coupling gear 412 and some of the plurality of gear teeth of the large diameter portion 431 mesh with each other. Further, some of the plurality of gear teeth of the small diameter portion 432 and some of the plurality of gear teeth of the agitator gear 44 mesh with each other. Thus, in a case where the coupling gear 412 rotates, the large diameter portion 431 rotates, so that the small diameter portion 432 rotates together with the large diameter portion 431. With the rotation of the small diameter portion 432, the agitator gear 44 rotates.

The agitator gear 44 is configured to rotate the agitator 20 inside the container 13. The agitator gear 44 is rotatable about the rotation axis extending in the first direction. A plurality of gear teeth are provided at equal intervals over the entire outer peripheral portion of the agitator gear 44. As described above, some of the plurality of gear teeth of the small diameter portion 432 and some of the plurality of gear teeth of the agitator gear 44 mesh with each other. The agitator gear 44 is fixed to the one end portion of the agitator shaft 21 in the first direction such that the agitator gear 44 is not rotatable relative to the agitator shaft 21. Thus, in a case where motive power is transmitted from the coupling 41 to the agitator gear 44 through the idle gear 43, the agitator gear 44 rotates, so that the agitator 20 rotates together with the agitator gear 44.

The cover 50 is fixed to the first outer surface 11 of the casing 10 by, e.g., screwing. The coupling gear 412, developing roller gear 42, idle gear 43, agitator gear 44, and IC chip assembly 60 are at least partially positioned between the first outer surface 11 and the cover 50. The cover 50 has a first opening 51 and a second opening 52. The fastening hole 413 of the coupling portion 411 is exposed outside the cover 50 through the first opening 51. An electric contact surface 611 of an IC chip 61 to be described later and a first slope 643 of a support member 64 to be described later are exposed outside the cover 50 through the second opening 52.

<2. IC Chip Assembly>

Figure 3:
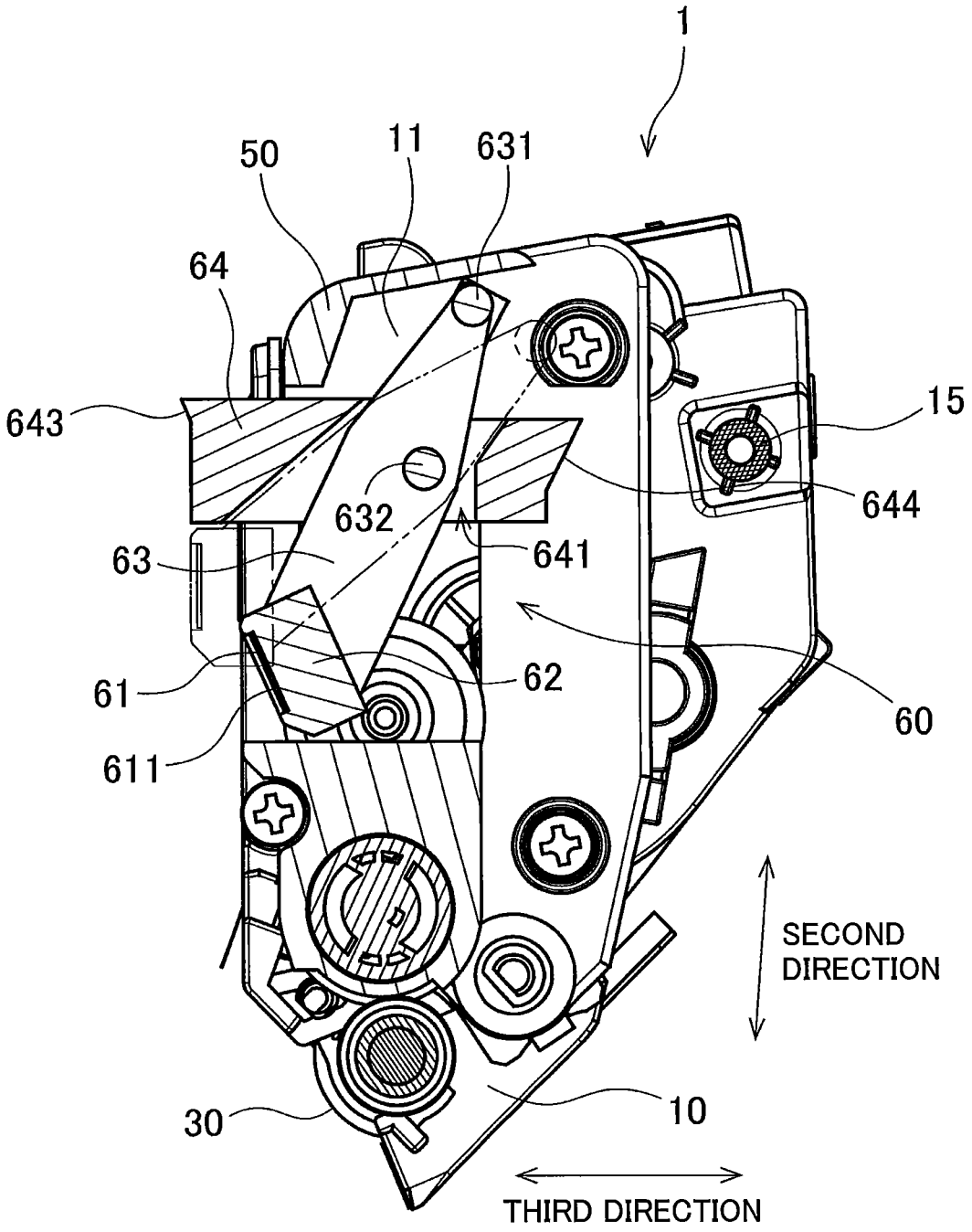
FIG. 3 is a cross-sectional view cutting the developing cartridge along a plane in the vicinity of an IC chip assembly according to the embodiment.

The IC chip assembly 60 is a unit including an IC chip 61 as an example of a storage medium. The IC chip assembly 60 is positioned at the first outer surface 11 of the casing 10. FIG. 3 is a cross-sectional view cutting the developing cartridge 1 in the vicinity of the IC chip assembly 60 along the plane orthogonal to the first direction. As illustrated in FIGS. 2 and 3, the IC chip assembly 60 includes an IC chip 61, a holder 62, a lever 63, and a support member 64.

The IC chip 61 is fixed to the end surface of the holder 62 in the third direction. The IC chip 61 stores therein various information concerning the developing cartridge 1. As illustrated in FIGS. 2 and 3, the IC chip 61 includes an electric contact surface 611. The electric contact surface 611 is made from an electrically conductive metal. The drawer unit 9 includes a terminal. In a case where the developing cartridge 1 is attached to the drawer unit 9, the electric contact surface 611 of the IC chip 61 is in contact with the terminal. As a result, the electric contact surface 611 and terminal are electrically conducted to each other. This allows the image forming apparatus to perform at least one of reading-out of information from the IC chip 61 and writing-in of information to the IC chip 61.

The holder 62 and lever 63 are integrally formed of, e.g., resin. However, the holder 62 and lever 63 may be separate members. At least a portion of the holder 62 and at least a portion of the lever 63 are covered by the cover 50. The lever 63 includes a boss 631. The boss 631 extends toward the cover 50 in the first direction at one end portion of the lever 63. The boss 631 may have a columnar shape as illustrated or other shapes such as a polygonal pillar. The holder 62 is positioned at the other end portion of the lever 63. The lever 63 holds the electric contact surface 611 of the IC chip 61 through the holder 62. Here, the one end portion and the other end portion of the lever 63 are examples of a first end portion and a second end portion of the lever 63, respectively.

The lever 63 is swingable about the rotation axis (second axis) extending in the first direction between first and second positions. In FIG. 3, the lever 63 at the first position is denoted by a continuous line, and the lever 63 at the second position is denoted by a long dashed double-short dashed line. In a case where the lever 63 swings, both of the holder 62 and IC chip 61 swing in the third direction together with the other end portion of the lever 63. More specifically, in a case where the one end portion of the lever 63 swings about the rotation axis (second axis), both of the holder 62 and IC chip 61 swing in the third direction together with the other end portion of the lever 63. Accordingly, the electric contact surface 611 of the IC chip 61 swings in the third direction. At this time, the electric contact surface 611 and the swing direction of the lever 63 cross each other. Hereinafter, the position of the electric contact surface 611 in a case where the lever 63 is at the first position is referred to as "retreat position", and the position of the electric contact surface 611 in a case where the lever 63 is at the second position is referred to as "advance position".

The electric contact surface 611 at the retreat position is at least partially positioned inside the cover 50 in a state of being exposed from the second opening 52 of the cover 50. In a case where the electric contact surface 611 is at the retreat position, the position of the electric contact surface 611 in the third direction is between one end part of the support member 64 in the third direction and the other end part of the support member 64 in the third direction. On the other hand, the electric contact surface 611 at the advance position is positioned outside the cover 50 in a state of being exposed outside the cover 50 through the second opening portion 52 of the cover 50. In other words, the electric contact surface 611 at the advance position protrudes outside the cover 50 through the second opening portion 52 of the cover 50. That is, the electric contact surface 611 at the advance position is farther from the cover 50 than the electric contact surface 611 at the retreat position is from the cover 50. In a case where the electric contact surface 611 being at the advance position, the electric contact surface 611 may be positioned farther from the other end part (end portion including a second slope 644 to be described later) of the support member 64 than from one end part (end portion including a first slope 643 to be described later) of the support member 64.

The cover 50 has a through hole 53. The through hole 53 penetrates the cover 50 in the first direction. The boss 631 of the lever 63 is inserted in the through hole 53. The size (inner dimension) of the through hole 53 in the second direction is greater than the size (outer dimension) of the boss 631 in the second direction. This allows the lever 63 and holder 62 to be move, together with the boss 631, relative to the casing 10 and cover 50 in the second direction. In a case where the lever 63 and holder 62 move in the second direction, the IC chip 61 including the electric contact surface 611 moves in the second direction together with the holder 62.

The size (inner dimension) of the through hole 53 in the third direction is greater than the size (outer dimension) of the boss 631 in the third direction. This allows the one end portion of the lever 63 to be moved, together with the boss 631, relative to the casing 10 and cover 50 in the third direction. In a case where the one end portion of the lever 63 moves in the third direction, the lever 63 swings about the second axis.

The lever 63 may include a plurality of bosses 631. In this case, the cover 50 may have one or a plurality of through holes 53 into which the plurality of bosses 631 are inserted. The through hole 53 need not penetrate the cover 50 and may be a hole into which the boss 631 of the lever 63 can be inserted. That is, the cover 50 may have a recessed portion into which the boss 631 is inserted in place of the through hole 53. The lever 63 may include a boss that protrudes toward the first outer surface 11 of the casing 10. In this case, the casing 10 may have a recessed portion or a through hole into which the boss is inserted.

The support member 64 is configured to swingably support the lever 63 about the second axis. At least a portion of the support member 64 is covered by the cover 50. The support member 64 is positioned between the one end portion and the other end portion of the lever 63. That is, the boss 631 and holder 62 are positioned at opposite sides relative to the support member 64. As illustrated in FIG. 3, the support member 64 has an insertion hole 641. The insertion hole 641 penetrates the support member 64 in the second direction. The lever 63 is inserted through the insertion hole 641.

As illustrated in FIGS. 2 and 3, the lever 63 includes a support shaft 632. The support shaft 632 protrudes from the lever 63 in the first direction along the second axis. The support member 64 has a support hole 642. The support shaft 632 is inserted through the support hole 642. This allows the lever 63 to be swung about the second axis relative to the support member 64. A configuration may be adopted in which the lever 63 has the support hole, and the support member 64 includes the support shaft to be inserted through the support hole.

The support member 64 extends in the third direction. One of the opposite end surfaces of the support member 64 in the third direction that is closer to the electric contact surface 611 includes a first slope 643. The first slope 643 is inclined relative to the second and third directions. The other one of the opposite end surfaces of the support member 64 in the third direction that is farther from the electric contact surface 611 includes a second slope 644. The second slope 644 is inclined relative to the second and third directions. The distance between the first and second slopes 643 and 644 in the third direction is gradually reduced toward the developing roller 30.

<3. Inserting Operation>

Figure 4:
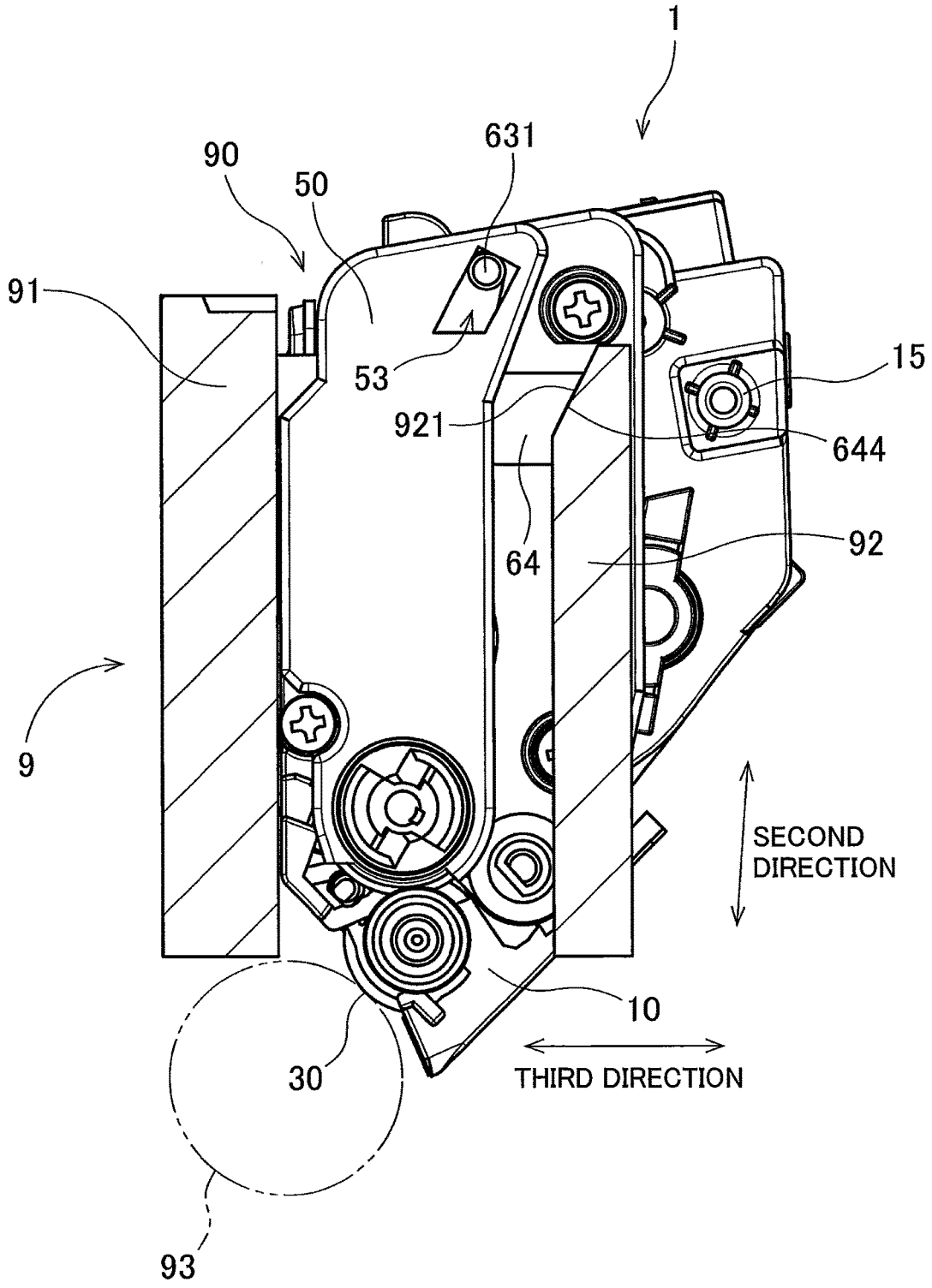
FIG. 4 is a view illustrating a state during an inserting operation of the developing cartridge according to the embodiment.
Figure 5:
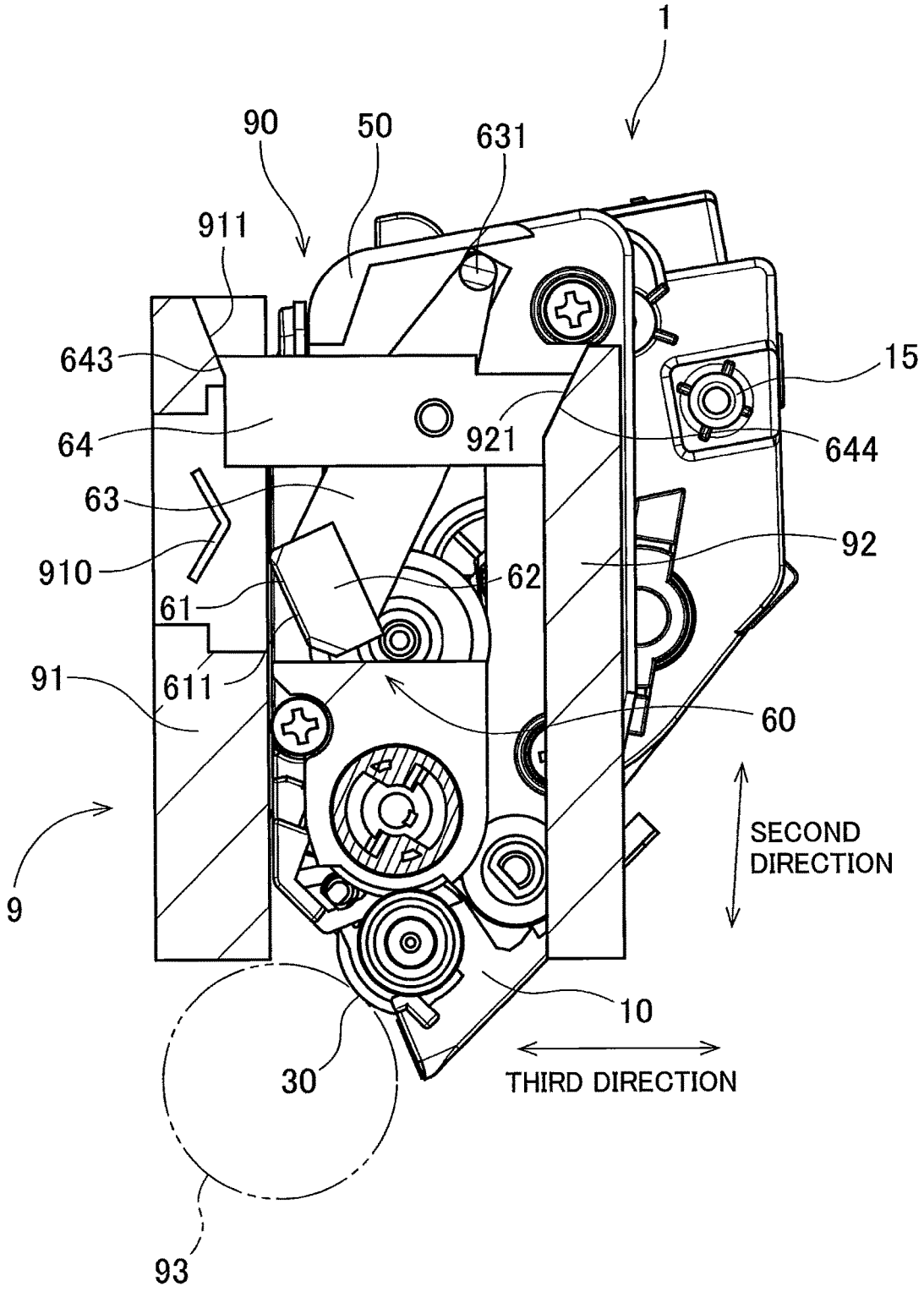
FIG. 5 is a view illustrating a state during the inserting operation of the developing cartridge according to the embodiment.

The following describes inserting operation of the developing cartridge 1 relative to the drawer unit 9. FIGS. 4 and 5 are views illustrating a state where the developing cartridge 1 is inserted in one slot 90 of the drawer unit 9. In FIG. 5, the cover 50 is omitted to clearly show the IC chip assembly 60.

As illustrated in FIGS. 4 and 5, the drawer unit 9 includes a first guide plate 91 and a second guide plate 92 for each slot 90. The first and second guide plates 91 and 92 each extend in the first and second directions. The first guide plate 91 includes a terminal 910. The terminal 910 is an electric contact that can contact the electric contact surface 611 of the IC chip 61. For example, as a material for the terminal 910, electrically conductive metal is used.

The first guide plate 91 includes a first holding surface 911. The first holding surface 911 is inclined such that the first holding surface 911 gradually comes closer to the second guide plate 92 toward a photosensitive drum 93. The second guide plate 92 includes a second holding surface 921. The second holding surface 921 is inclined so as to gradually come close to the first guide plate 91 toward the photosensitive drum 93. The first and second holding surfaces 911 and 921 face each other in the third direction.

As illustrated in FIGS. 4 and 5, in a state where the developing cartridge 1 is inserted in the slot 90, the first slope 643 of the support member 64 is in contact with the first holding surface 911, and the second slope 644 of the support member 64 is in contact with the second holding surface 921. As a result, the support member 64 is fixed in position relative to the drawer unit 9 in the second and third directions. In a case where the casing 10 of the developing cartridge 1 is further pushed into the slot 90, the boss 631 of the lever 63 is in contact with the edge of the through hole 53 of the cover 50. As a result, the casing 10 is fixed in position relative to the drawer unit 9 in the second direction.

As illustrated in FIG. 5, at insertion of the developing cartridge 1 into the slot 90, the lever 63 is at the first position by the weights of the holder 62 and IC chip 61. Accordingly, the electric contact surface 611 of the IC chip 61 is at the retreat position. This prevents the electric contact surface 611 from rubbing against the terminal 910 at insertion of the developing cartridge 1 into the slot 90.

<4. Pivoting Operation>

Figure 6:
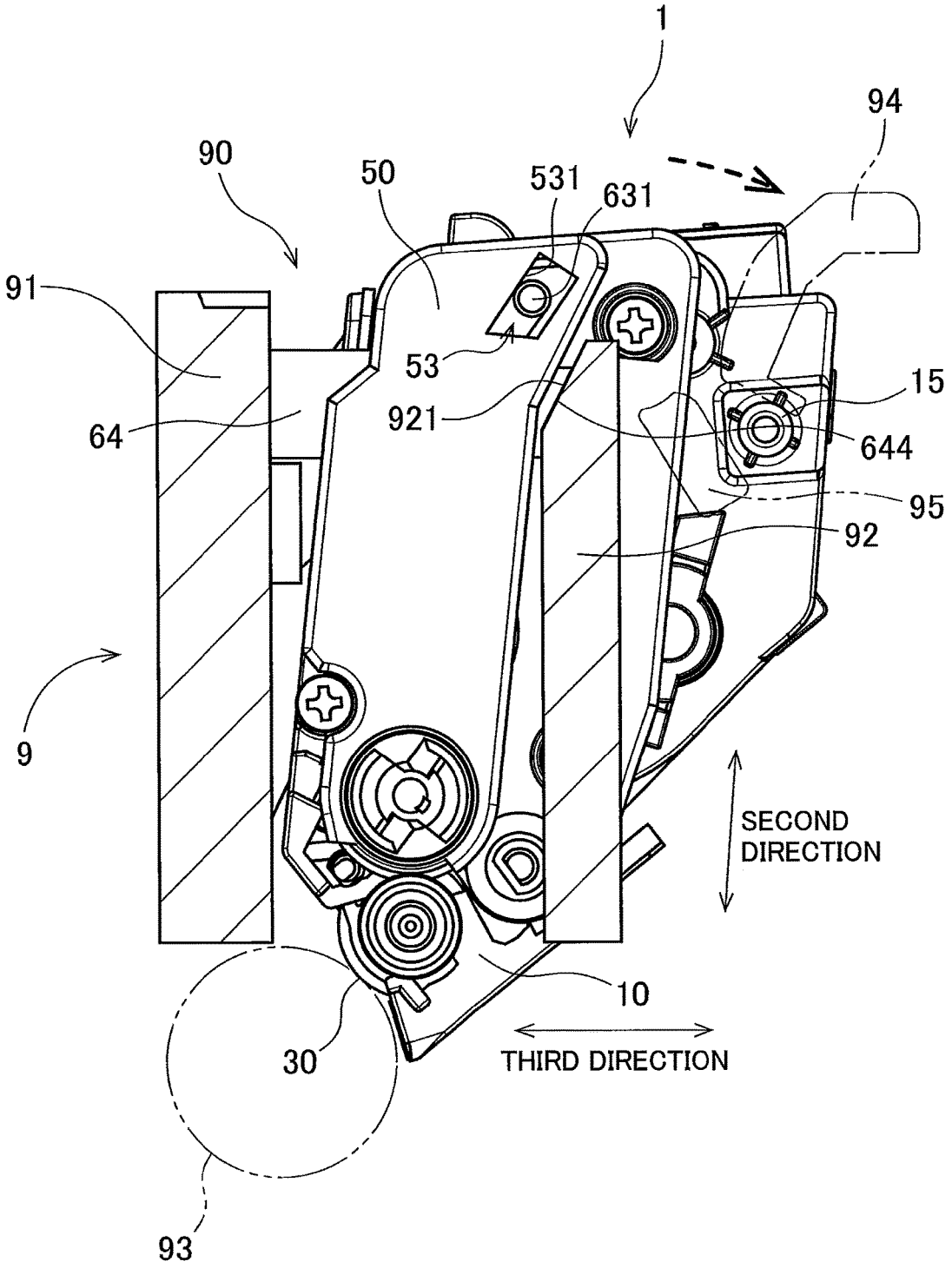
FIG. 6 is a view illustrating a state during a pivoting operation of the developing cartridge according to the embodiment.
Figure 7:
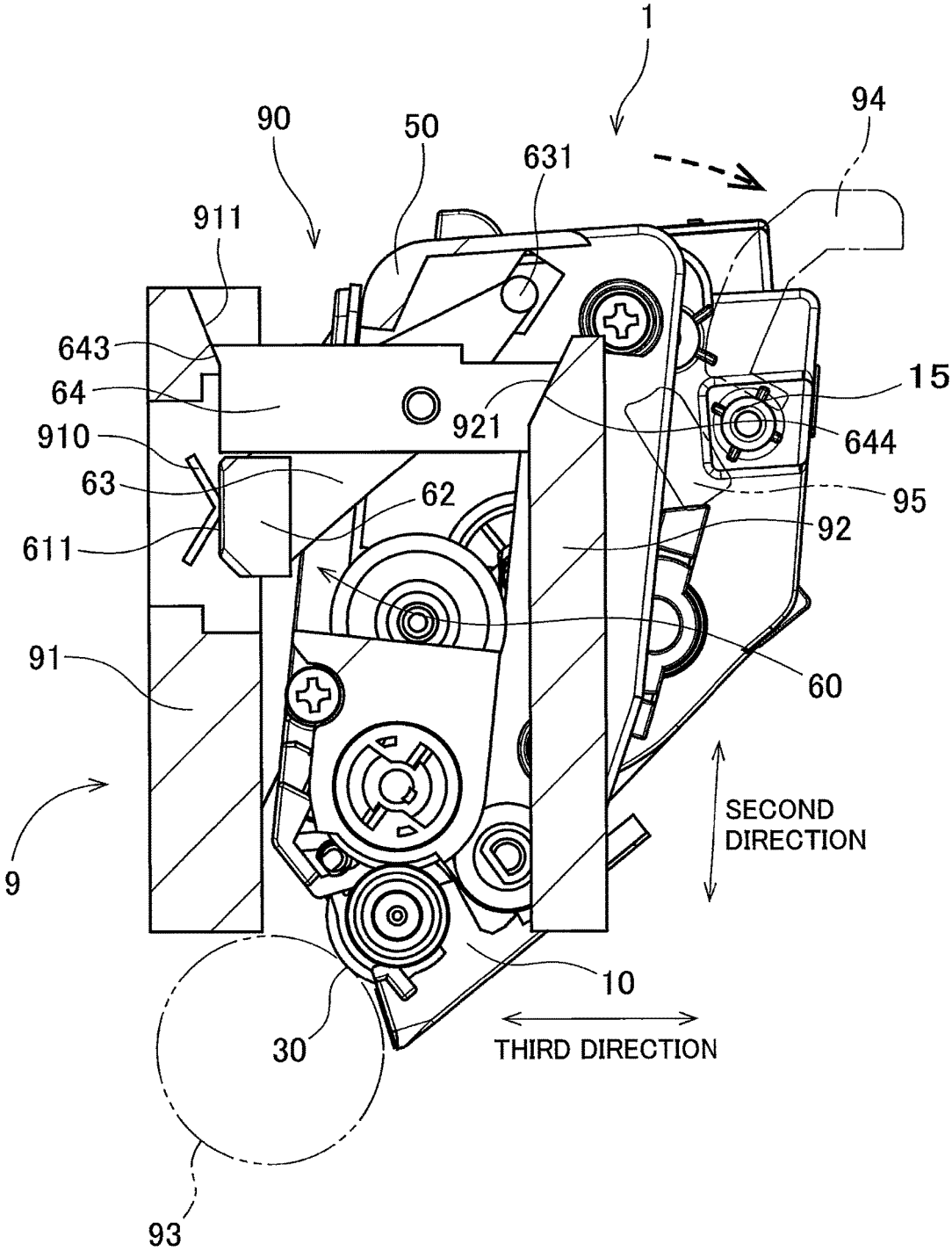
FIG. 7 is a view illustrating a state during the pivoting operation of the developing cartridge according to the embodiment.

The following describes the pivoting operation of the casing 10 and cover 50 after insertion of the developing cartridge 1 into the slot 90. FIGS. 6 and 7 are views illustrating the pivoting operation. In FIG. 7, the cover 50 is omitted to clearly showing the IC chip assembly 60.

As illustrated in FIGS. 6 and 7, the casing 10 has a columnar protrusion 15. The columnar protrusion 15 extends in the first direction from the first outer surface 11 of the casing 10. The columnar protrusion 15 is exposed outside without being covered by the cover 50.

After insertion of the developing cartridge 1 into the slot 90, the casing and cover 50 pivots about the developing roller 30 in a state where the casing 10 is further pressed toward the support member 64 relative to the developing roller 30. As denoted by a dashed arrow in FIGS. 6 and 7, the casing 10 is inclined to the third direction. At this time, the columnar protrusion 15 of the casing 10 is in contact with a pressure member 94 of the drawer unit 9. The pressure member 94 is configured to press the columnar protrusion 15 toward the photosensitive drum 93. Accordingly, the developing roller 30 is pressed against the photosensitive drum 93. That is, the developing roller 30 and photosensitive drum 93 are kept in a contact state where the developing roller 30 and the photosensitive drum 93 contact each other.

Further, in a case where the casing 10 and cover 50 pivot about the developing roller 30 in the pivoting operation, an edge portion 531 of the through hole 53 of the cover 50 presses the boss 631 of the lever 63, moving the boss 631 in the third direction. That is, in the present embodiment, the boss 631 serves as a pressed portion that receives pressing force in the pivoting operation. In a case where the boss 631 moves in the third direction, the lever 63 swings about the second axis from the first position to second position. Accordingly, the electric contact surface 611 of the IC chip 61 swings from the retreat position to the advance position. As a result, the electric contact surface 611 is in contact with the terminal 910. This allows a control section of the image forming apparatus to perform at least one of reading-out of information from the IC chip 61 and writing-in of information to the IC chip 61.

When the electric contact surface 611 is in contact with the terminal 910 halfway through the insertion of the developing cartridge 1 into the slot 90, the electric contact surface 611 moves in the second direction while contacting the terminal 910. In this case, rubbing is likely to occur between the electric contact surface 611 and the terminal 910. However, in the configuration according to the present embodiment, the electric contact surface 611 is made to contact the terminal 910 by swinging the lever 63 after insertion of the developing cartridge 1 into the slot 90 and after fixing the position of the support member 64. Thus, after the electric contact surface 611 is in contact with the terminal 910, contact position of the electric contact surface 611 relative to the terminal 910 hardly changes. This can suppress rubbing of the electric contact surface 611 against the terminal 910.

Particularly, in the present embodiment, the length from the second axis to the electric contact surface 611 is greater than the length from the second axis to the boss 631 as the pressed portion. Accordingly, the distance at which the electric contact surface 611 is moved by the swing operation is longer than the distance at which the boss 631 is moved by the swing operation. That is, by making the moving distance of the electric contact surface 611 larger, the electric contact surface 611 can be made to contact the terminal 910 more reliably.

<Separating Operation>

Figure 8:
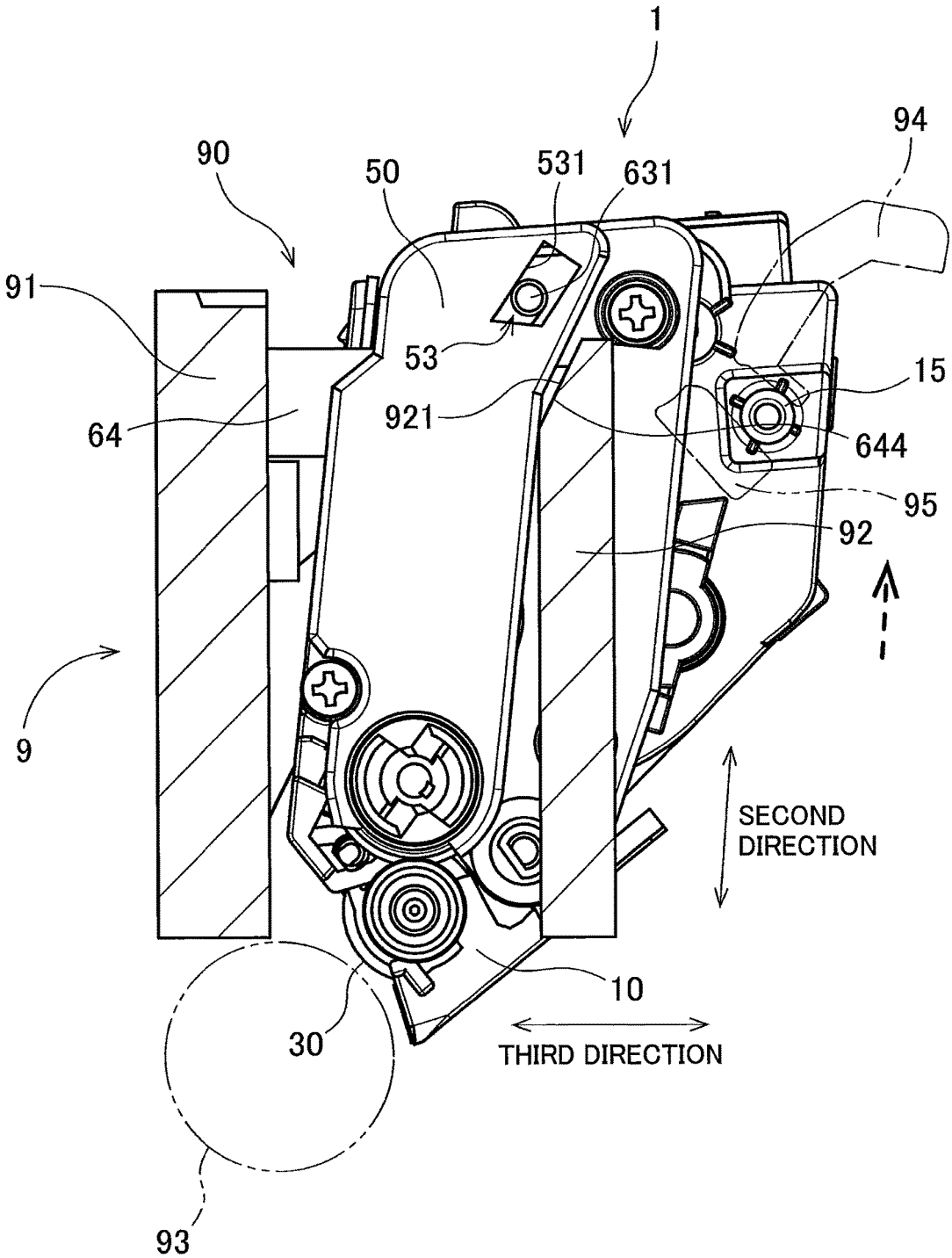
FIG. 8 is a view illustrating a state during a separating operation of the developing cartridge according to the embodiment.
Figure 9:
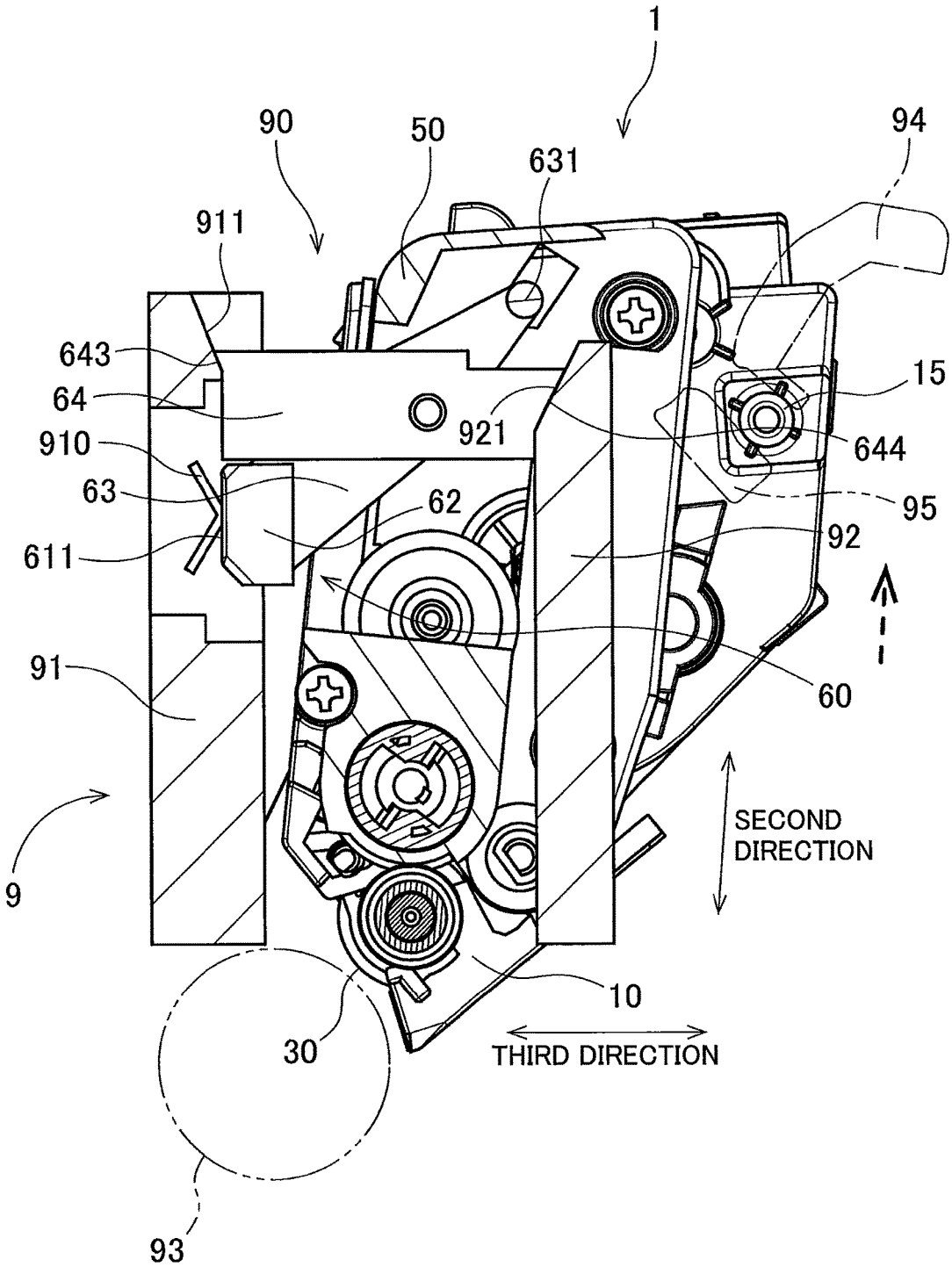
FIG. 9 is a view illustrating a state during the separating operation of the developing cartridge according to the embodiment.

After completion of the above-described inserting operation and pivoting operation, the image forming apparatus can perform "separating operation" where the developing roller 30 is temporarily separated from the photosensitive drum 93. Hereinafter, this separating operation will be described. FIGS. 8 and 9 are views illustrating a state where the separating operation is performed. In FIG. 9, the cover 50 is omitted to clearly show the IC chip assembly 60.

In a case where the separating operation is performed, a lever (not illustrated) of the drawer unit 9 is pressed by drive force from the image forming apparatus. Then, a separating member 95 of the drawer unit 9 moves in the second direction toward the pressure member 94. Then, the separating member 95 is in contact with the columnar protrusion 15 to press the columnar protrusion 15 against the pressure of the pressure member 94 in the direction separating from the photo sensitive drum 93. Then, as dented by a dashed arrow in FIGS. 8 and 9, the casing 10, developing roller 30, and cover 50 of the developing cartridge 1 move in the second direction. As a result, the developing roller 30 and photosensitive drum 93 are separated from each other.

At this time, the boss 631 of the lever 63 relatively moves in the second direction along the edge portion 531 of the through hole 53. That is, in the present embodiment, a portion of the surface constituting the edge portion 531 of the through hole 53 serves as a guide surface for guiding the boss 631 in the second direction.

The positions of the support member 64, lever 63, holder 62, and IC chip 61 relative to the drawer unit 9 are not changed in both the contacting state before the separating operation (state illustrated in FIGS. 6 and 7) and separating state after the separating operation (state illustrated in FIGS. 8 and 9). That is, the lever 63 is kept at the second position, and the electric contact surface 611 is kept at the advance position, while the casing 10, developing roller 30, and cover 50 move in the second direction relative to the drawer unit 9, support member 64, lever 63, holder 62, and IC chip 61.

Thus, during the separating operation, the casing 10, developing roller 30, and cover 50 move in the second direction, while the position of the electric contact surface 611 relative to the drawer unit 9 is not changed. Thus, the electric contact surface 611 is kept in contact with the terminal 910. Further, rubbing of the electric contact surface 611 during the separating operation is reduced.

In the present embodiment, the direction (separating direction) in which the developing roller 30 is separated from the photosensitive drum 93 during the separating operation is the second direction. However, the separating direction may be a direction other than the second direction. The separating direction may be any direction as long as it crosses the first direction.

<6. Modifications>

While one embodiment of the present disclosure has thus been described, the present disclosure is not limited to the above embodiment. Hereinafter, various modifications will be described focusing differences from the above embodiment.

<6-1. First Modification>

Figure 10:
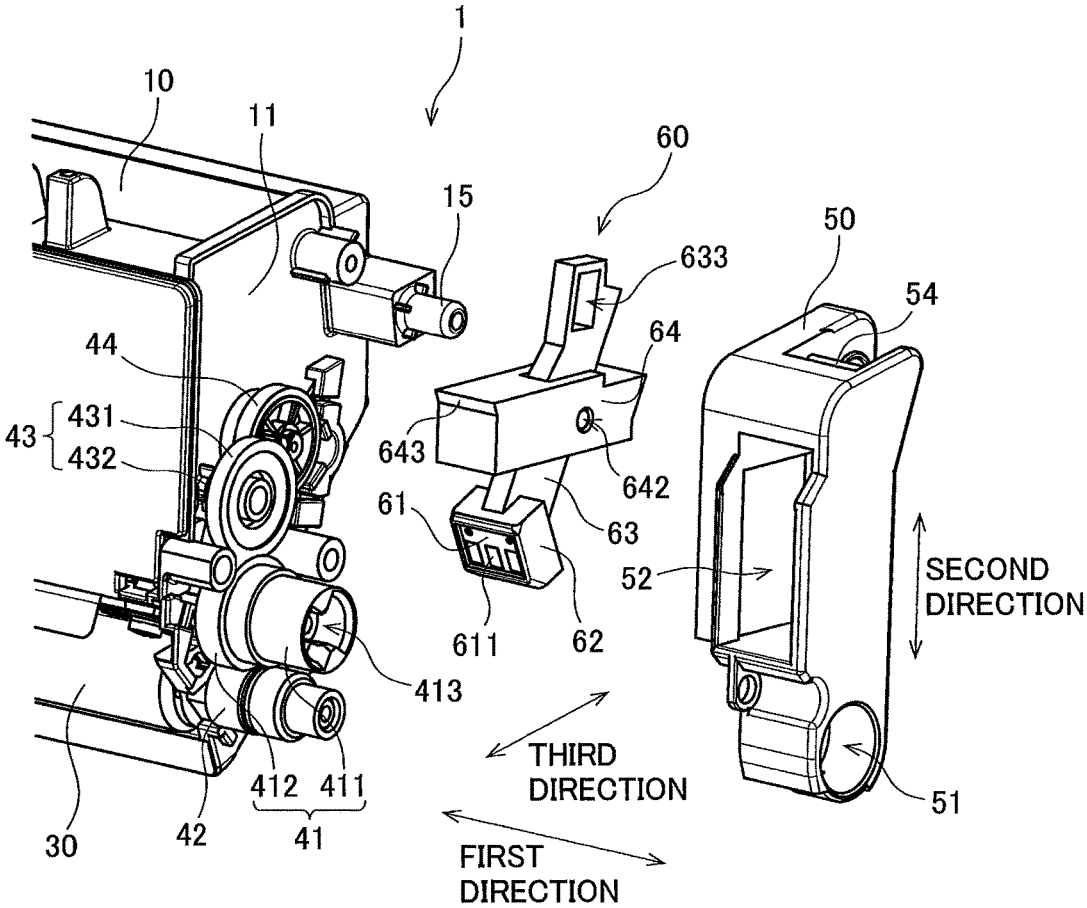
FIG. 10 is a partially exploded perspective view of a developing cartridge according to a first modification.
Figure 11:
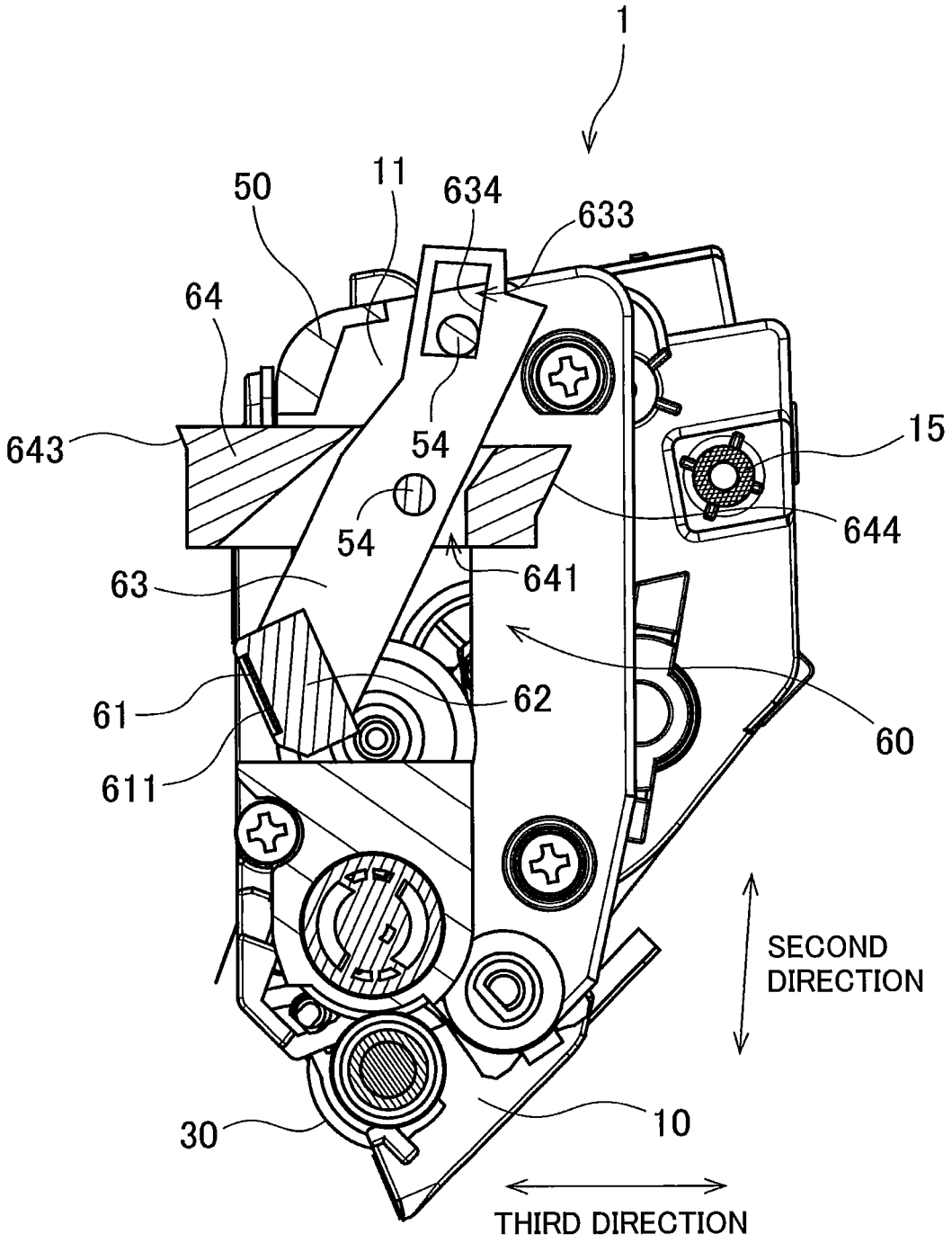
FIG. 11 is a cross-sectional view cutting the developing cartridge along a plane in the vicinity of an IC chip assembly according to the first modification.

FIG. 10 is a partially exploded perspective view of the developing cartridge 1 according to a first modification. FIG. 11 is a cross-sectional view cutting the developing cartridge 1 according to the first modification in the vicinity of the IC chip assembly 60 along the plane orthogonal to the first direction.

The first modification differs from the above embodiment in the configuration of the lever 63 and the configuration of the cover 50 supporting the lever 63. In this example, the lever 63 has a through hole 633 in place of the boss 631. The cover 50 includes a boss 54 to be inserted in the through hole 633 of the lever 63 in place of the through hole 53 into which the boss 631 is inserted.

In the examples of FIGS. 10 and 11, the cover 50 includes the boss 54. The boss 54 extends in the first direction. The lever 63 has the through hole 633. The through hole 633 penetrates one end portion of the lever 63 in the first direction. The through hole 633 and holder 62 are positioned at opposite sides relative to the support member 64.

The boss 54 of the cover 50 is inserted through the through hole 633 of the lever 63. The size (inner dimension) of the through hole 633 in the second direction is greater than the size (outer dimension) of the boss 54 in the second direction. This allows both of the lever 63 and holder 62 to move, together with the through hole 633, relative to the casing 10 and cover 50 in the second direction. In a case where the lever 63 and holder 62 move in the second direction, the IC chip 61 including the electric contact surface 611 also moves in the second direction together with the holder 62.

Further, the size (inner dimension) of the through hole 633 in the third direction is greater than the size (outer dimension) of the boss 54 in the third direction. This allows the one end portion of the lever 63 to move, together with the through hole 633, relative to the casing 10 and cover 50 in the third direction. In a case where the one end portion of the lever 63 moves in the third direction, the lever 63 swings about the second axis.

During the pivoting operation, the boss 54 of the cover 50 presses an edge portion 634 of the through hole 633 of the lever 63. As a result, the one end portion of the lever 63 moves in the third direction. That is, in the first modification, the edge portion 634 of the through hole 633 serves as a pressed portion that receives pressing force during the pivoting operation. In a case where the one end portion of the lever 63 moves in the third direction, the lever 63 swings from the first position to the second position about the second axis. Accordingly, the electric contact surface 611 of the IC chip 61 swings from the retreat position to the advance position. As a result, the electric contact surface 611 is in contact with the terminal 910.

During the separating operation, the boss 54 of the cover 50 moves in the second direction along the edge portion 634 of the through hole 633. That is, in the first modification, a portion of the surface constituting the edge portion 634 of the through hole 633 serves as a guide surface for guiding the boss 54 in the second direction.

The cover 50 may include a plurality of bosses 54. In this case, the lever 63 may have one or a plurality of through holes 633 into which the plurality of bosses 54 are inserted. The lever 63 may have a recessed portion into which the boss 54 is inserted in place of the through hole 633. The casing 10 may include a boss that protrudes toward the first outer surface 11 in the first direction. In this case, the lever 63 may have a recessed portion or a through hole into which the boss of the casing 10 is inserted.

<6-2. Second Modification>

Figure 12:
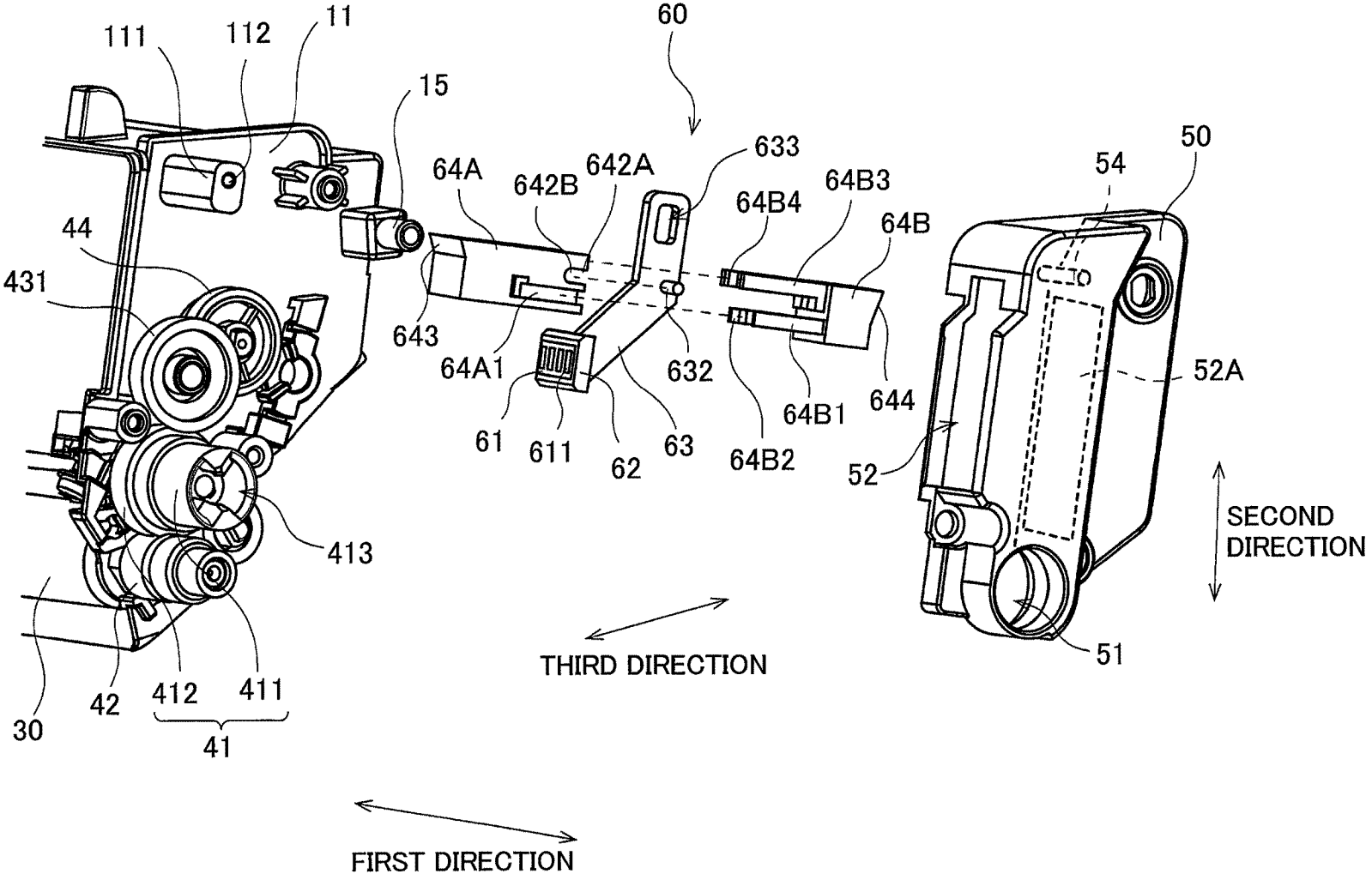
FIG. 12 is a partially exploded perspective view of a developing cartridge according to a second modification.
Figure 13:
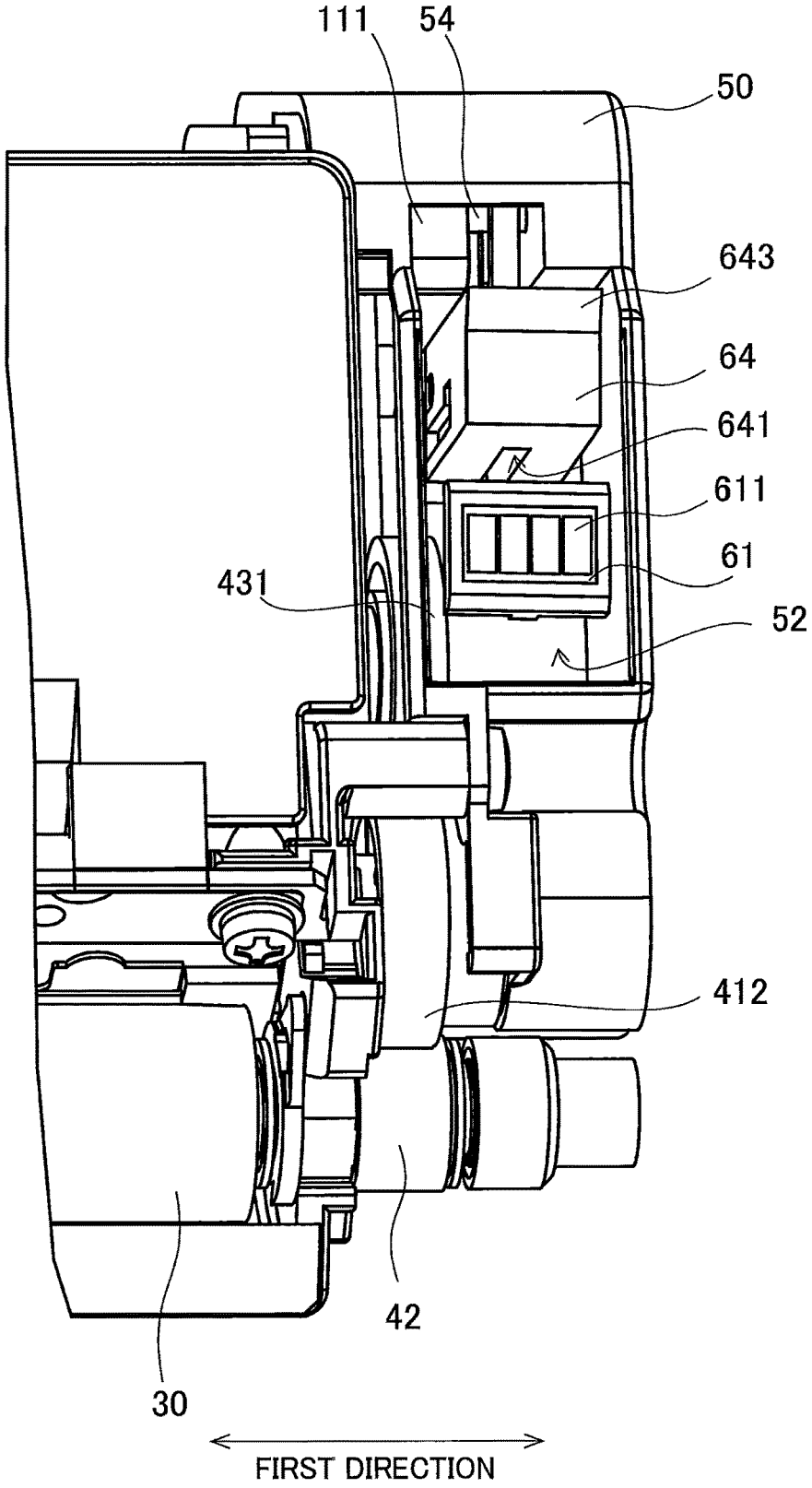
FIG. 13 is a partial front view of the developing cartridge according to the second modification obtained by assembling dismantled parts illustrated in FIG. 12.

FIG. 12 is a partially exploded perspective view of the developing cartridge 1 according to a second modification. FIG. 13 is a partial front view of the developing cartridge 1 according to the second modification obtained by assembling the dismantled parts illustrated in FIG. 12.

The second modification differs from the above embodiment in the configuration of the lever 63 and the configuration of the support member 64 supporting the lever 63. In this example, the lever 63 has the through hole 633 in place of the boss 631. The cover 50 includes the boss 54 to be inserted into the through hole 633 of the lever 63 in place of the through hole 53 into which the boss 631 is inserted. The casing 10 further has an insertion hole 112 in the first outer surface 11, into which the boss of the cover 50 is inserted. Further, the support member 64 includes a first support member 64A and a second support member 64B which are assembled with each other. Although the IC chip 61 illustrated in FIGS. 12 and 13 includes four electric contact surfaces 611, the number of the electric contact surfaces 611 may be three as in the above embodiment.

As illustrated in FIG. 12, the support member 64 includes the first support member 64A and second support member 64B. The first support member 64A and second support member 64B are arranged side by side in the third direction. The support member 64 is assembled by assembling the first support member 64A and the second support member 64B. The first support member 64A includes a groove 64A1 extending in the third direction. The second support member 64B includes a protrusion 64B1 extending in the third direction. As denoted by a dashed line in FIG. 12, in a case where the first support member 64A and the second support member 64B are assembled with each other, the protrusion 64B1 is inserted into the groove 64A1. Further, the second support member 64B includes a protrusion 64B2 extending in the third direction, and the first support member 64A includes a groove (not illustrated) extending in the third direction. The protrusion 64B2 is inserted into the groove. Further, the second support member 64B includes a protrusion 64B3 extending in the third direction, and the first support member 64A has a groove (not illustrated) extending in the third direction. The protrusion 64B3 is inserted into the groove. Further, the second support member 64B includes a protrusion 64B4 extending in the third direction, and the first support member 64A includes a groove (not illustrated) extending in the third direction. The protrusion 64B4 is inserted into the groove.

The first support member 64A further includes a support groove 642A extending in the third direction. In a state where the first support member 64A and the second support member 64B are assembled with each other, a support hole 642B is formed between the support groove 642A and the second support member 64B. The support shaft 632 of the lever 63 is inserted into the support hole 642B to be supported thereby.

As in the first modification, the lever 63 has the through hole 633. The cover 50 includes the boss 54. The boss 54 protrudes in the first direction toward the casing 10. The first outer surface 11 of the casing 10 includes a protrusion 111 protruding in the first direction toward the cover 50. The projection 111 has the insertion hole 112. The boss 54 of the cover 50 is inserted into the insertion hole 112 in a case where the cover 50 is fixed to the first outer surface 11 of the casing 10.

The boss 54 of the cover 50 is inserted through the through hole 633 of the lever 63 and then into the insertion hole 112 of the protrusion 111. This allows the lever 63 and holder 62 to move, together with the through hole 633, in the second direction relative to the casing 10 and cover 50. In a case where the lever 63 and holder 62 move in the second direction, the IC chip 61 including the electric contact surface 611 also moves in the second direction together with the holder 62.

The cover 50 has a third opening 52A that faces the second opening 52 in the third direction. The second opening 52 and third opening 52A have substantially the same size and are each has a shape large enough to allow the first support member 64A and second support member 64B to pass therethrough. In a case where the lever 63 is supported by the first support member 64A and second support member 64B, the boss 54 of the cover 50 is inserted through the through hole 633 of the lever 63 to fix the cover 50 to the first outer surface 11 of the casing 10. After that, the first support member 64A and the second support member 64B are inserted from the second opening 52 and the third opening 52A, respectively. As a result, the lever 63 is supported by the support member 64 obtained by assembling the first support member 64A and the second support member 64B together.

In a case where the developing cartridge 1 is inserted into the slot 90, the first slope 643 of the support member 64 is in contact with the first holding surface 911 (see FIG. 5), and the second slope 644 of the support member 64 is in contact with the second holding surface 921 (see FIGS. 4 and 5). As a result, the support member 64 is fixed in position relative to the drawer unit 9 in the second and third directions. In a case where the casing 10 of the developing cartridge 1 is further pushed into the slot 90, the boss 54 of the cover 50 is in contact with the edge of the through hole 633 of the lever 63. As a result, the casing 10 is fixed in position relative to the drawer unit 9 in the second direction.

<6-3. Third Modification>

Figure 14:
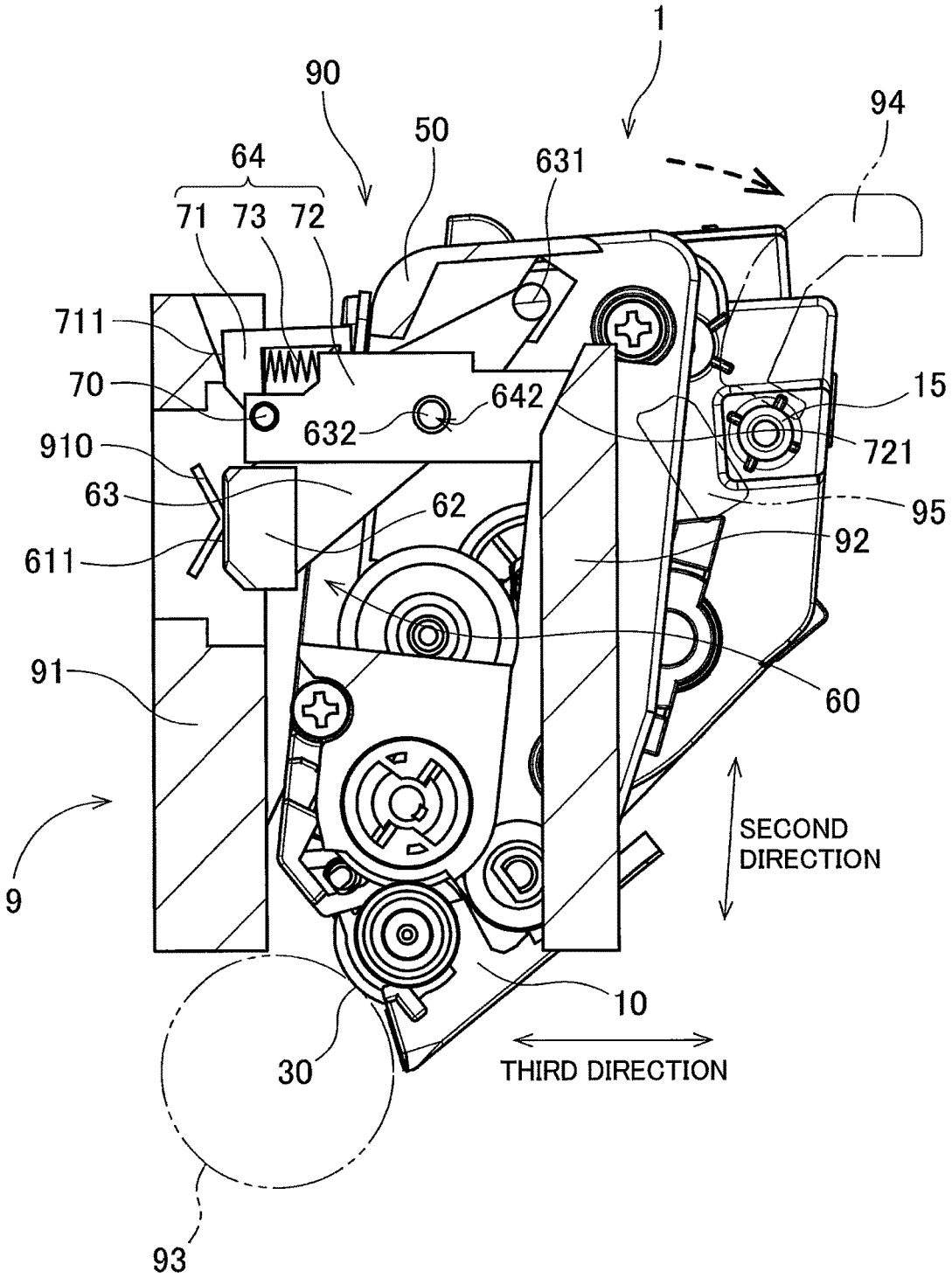
FIG. 14 is a view illustrating a state during a pivoting operation of a developing cartridge according to a third modification.

FIG. 14 is a view illustrating a state during the pivoting operation of the developing cartridge 1 according to a third modification.

The third modification differs from the above embodiment in that the whole support member 64 is not a rigid body, but the support member 64 is stretchable or compressible. In this example, the support member 64 includes a first support member 71 including a first contact surface 711, a second support member 72 including a second contact surface 721, and a pressing member 73 in place of the first and second slopes 643 and 644.

The support member 64 includes the first support member 71, second support member 72, and pressing member 73. The first support member 71 and second support member 72 are arranged side by side in the third direction. The pressing member 73 is positioned between the first and second support members 71 and 72 in the third direction.

The second support member 72 has the support hole 642. The support shaft 632 of the lever 63 is inserted into the support hole 642. This allows the lever 63 to be swung about the second axis relative to the support member 64. A configuration may be adopted in which the lever 63 has the support hole, and the second support member 72 includes the support shaft to be inserted through the support hole.

The first and second support members 71 and 72 are connected to each other at a hinge portion 70. The first and second support members 71 and 72 can pivot about the axis extending in the first direction along the hinge portion 70. The first support member 71 includes the first contact surface 711. The first contact surface 711 is positioned at the one end part of the support member 64 in the third direction. The second support member 72 includes the second contact surface 721. The second contact surface 721 is positioned at the other end part of the support member 64 in the third direction.

The pressing member 73 is stretched or compressed in the third direction. One end of the pressing member 73 in the third direction is connected to the first support member 71, while the other end of the pressing member 73 in the third direction is connected to the second support member 72. The pressing member 73 is, e.g., a coil spring which is an elastic member. Alternatively, in place of the coil spring, other elastic member such as a torsion spring may be used.

As illustrated in FIG. 14, in a state where the developing cartridge 1 is inserted in the slot 90, the first contact surface 711 of the first support member 71 is in contact with the first guide plate 91. Further, the second contact surface 721 of the second support member 72 is in contact with the second guide plate 92. As a result, the first and second support members 71 and 72 come close to each other in the third direction, making the length of the pressing member 73 in the third direction shorter than the natural length of the pressing member 73, which causes repulsive force in the third direction in the pressing member 73. Accordingly, the first support member 71 and the second support member 72 are pressed against the first guide plate 91 and the second guide plate 92, respectively. As a result, the first and second support members 71 and 72 are positioned in the second and third directions between the first and second guide plates 91 and 92. That is, the support member 64 is positioned in the second and third directions relative to the slot 90.

<6-4. Fourth Modification>

Figure 15:
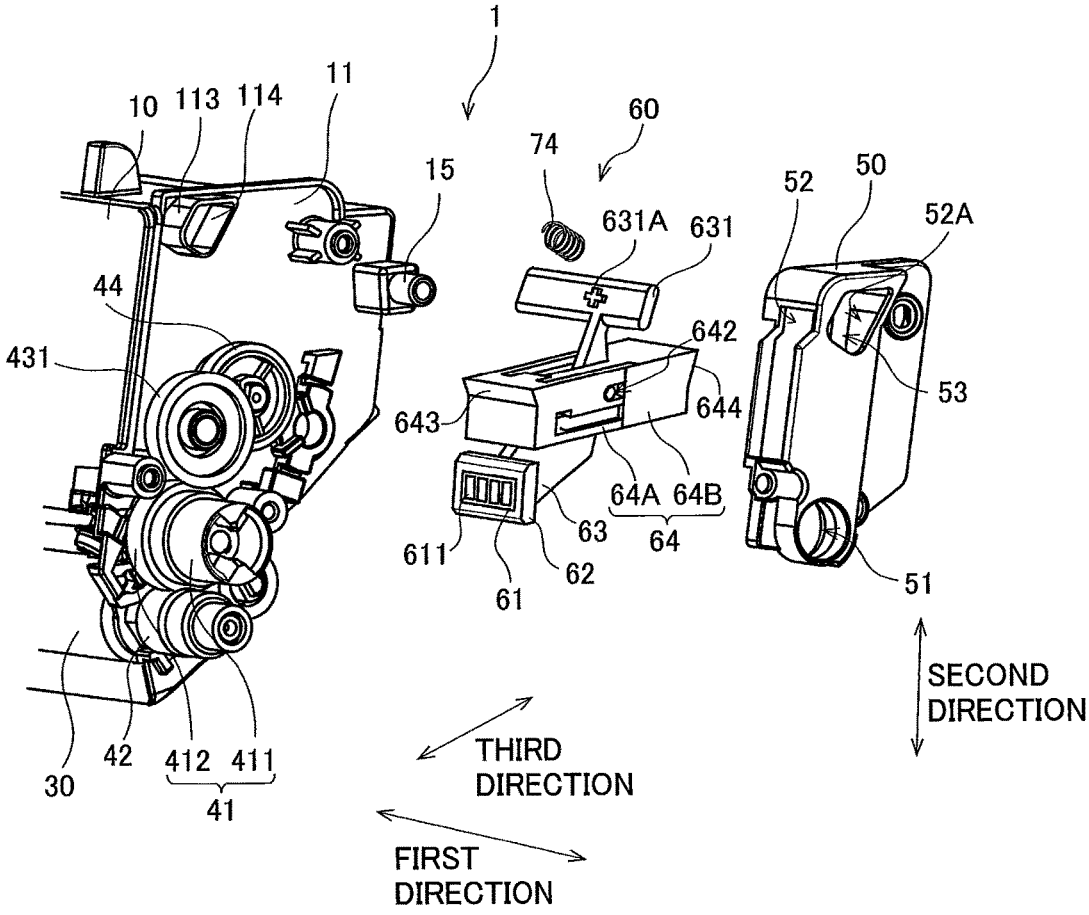
FIG. 15 is a partially exploded perspective view of a developing cartridge according to a fourth modification.
Figure 16:
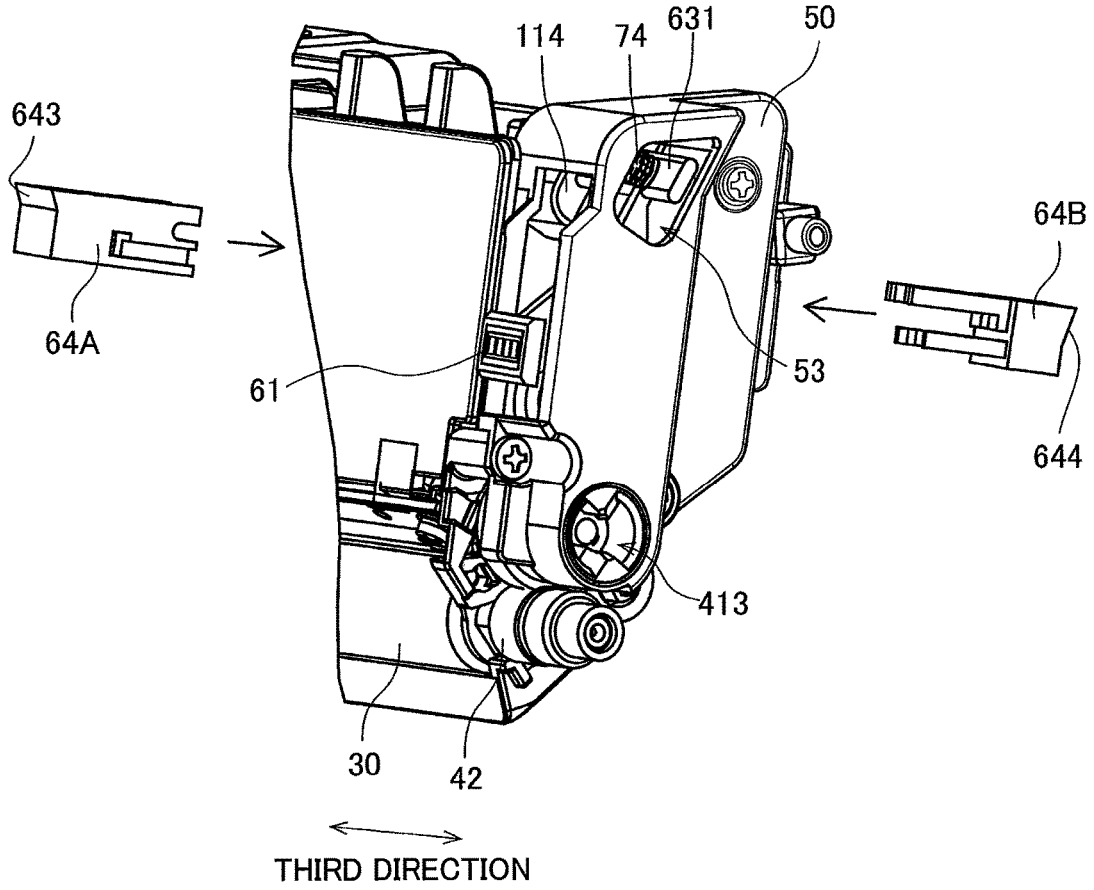
FIG. 16 is a partially exploded perspective view of the developing cartridge according to the fourth modification in a state where the cover is fixed to the developing cartridge.

FIG. 15 is a partially exploded perspective view of the developing cartridge 1 according to a fourth modification. FIG. 16 is a partially exploded perspective view of the developing cartridge 1 according to the fourth modification in a state where the cover 50 is fixed to the developing cartridge 1.

The fourth modification differs from the above embodiment in that a pressing member that swings the lever 63 is used. In this example, the lever 63 includes the boss 631 that has a substantially flat-plate shape and a protrusion 631A in place of the substantially columnar shaped boss 631. The casing 10 further has an insertion hole 114 in the first outer surface 11, into which the boss 631 of the lever 63 is inserted. Further, the support member 64 includes the first and second support members 64A and 64B which are assembled with each other. Although the IC chip 61 illustrated in FIGS. 15 and 16 includes four electric contact surfaces 611, the number of the electric contact surfaces 611 may be three as in the above embodiment.

In the example illustrated in FIGS. 15 and 16, the first outer surface 11 of the casing 10 includes a protrusion 113 protruding in the first direction. The protrusion 113 has an insertion hole 114 extending in the first direction. The insertion hole 114 faces the through hole 53 of the cover 50 in the first direction. The size and shape of the insertion hole 114 in the first direction is substantially the same as those of the through hole 53. The size (inner dimension) of the through hole 53 and insertion hole 114 in the second direction is greater than the size (outer dimension) of the boss 631 in the second direction. The size (inner dimension) of the through hole 633 and insertion hole 114 in the third direction is greater than the size (outer dimension) of the boss 631 in the third direction. One end portion of the boss 631 of the lever 63 in the first direction is inserted through the through hole 53. The other end of the boss 631 of the lever 63 in the first direction is inserted in the insertion hole 114.

This allows the lever 63 and holder 62 to move, together with the boss 631, in the second direction relative to the casing 10 and cover 50. In a case where both of the lever 63 and holder 62 move in the second direction, the IC chip 61 including the electric contact surface 611 also moves in the second direction together with the holder 62. The one end portion of the lever 63 can move, together with the boss 631, in the third direction relative to the casing 10 and cover 50. In a case where the one end portion of the lever 63 moves in the third direction, the lever 63 swings about the second axis.

In the fourth modification, the boss 631 of the lever 63 has a substantially rectangular parallelepiped shape extending in the first direction. The protrusion 631A is positioned at one surface of the rectangular parallelepiped shape that crosses the third direction. The protrusion 631A is a pillar extending in the third direction, having a crisscross shape in a plan view in the third direction.

The IC chip assembly 60 includes a pressing member 74 for swinging the lever 63 about the second axis. The pressing member 74 is supported by the protrusion 631A. The pressing member 74 is, e.g., a coil spring which is an elastic member. Alternatively, in place of the coil spring, other elastic member such as a torsion spring may be used. The pressing member 74 is stretched or compressed in the third direction. One end of the pressing member 74 in the third direction is supported by the boss 631. The other end of the pressing member 74 in the third direction is supported by the inner wall surface of the cover 50. The pressing member 74 is supported by the boss 631 and inner wall surface of the cover 50 while being compressed shorter than the natural length thereof.

As in the second modification, the support member 64 includes the first support member 64A and the second support member 64B. The lever 63 is supported by the support member 64, which is made by assembling the first and second support members 64A and 64B. The support member 64 is assembled in the same manner as in the second modification. That is, the cover 50 is fixed to the first outer surface 11 of the casing 10, and then the first and second support members 64A and 64B are inserted respectively through the second opening 52 and the third opening 52A.

In a case where the developing cartridge 1 is inserted in the slot 90, the first slope 643 of the support member 64 is in contact with the first holding surface 911 (see FIG. 5), and the second slope 644 of the support member 64 is in contact with the second holding surface 921 (see FIGS. 4 and 5). As a result, the support member 64 is fixed in position relative to the drawer unit 9 in the second and third directions. In a case where the casing 10 of the developing cartridge 1 is further pushed into the slot 90, the boss 631 of the lever 63 is in contact with the edge of the through hole 53 of the cover 50 or the edge of the insertion hole 114 of the casing 10. As a result, the casing 10 is fixed in position relative to the drawer unit 9 in the second direction.

Figure 17:
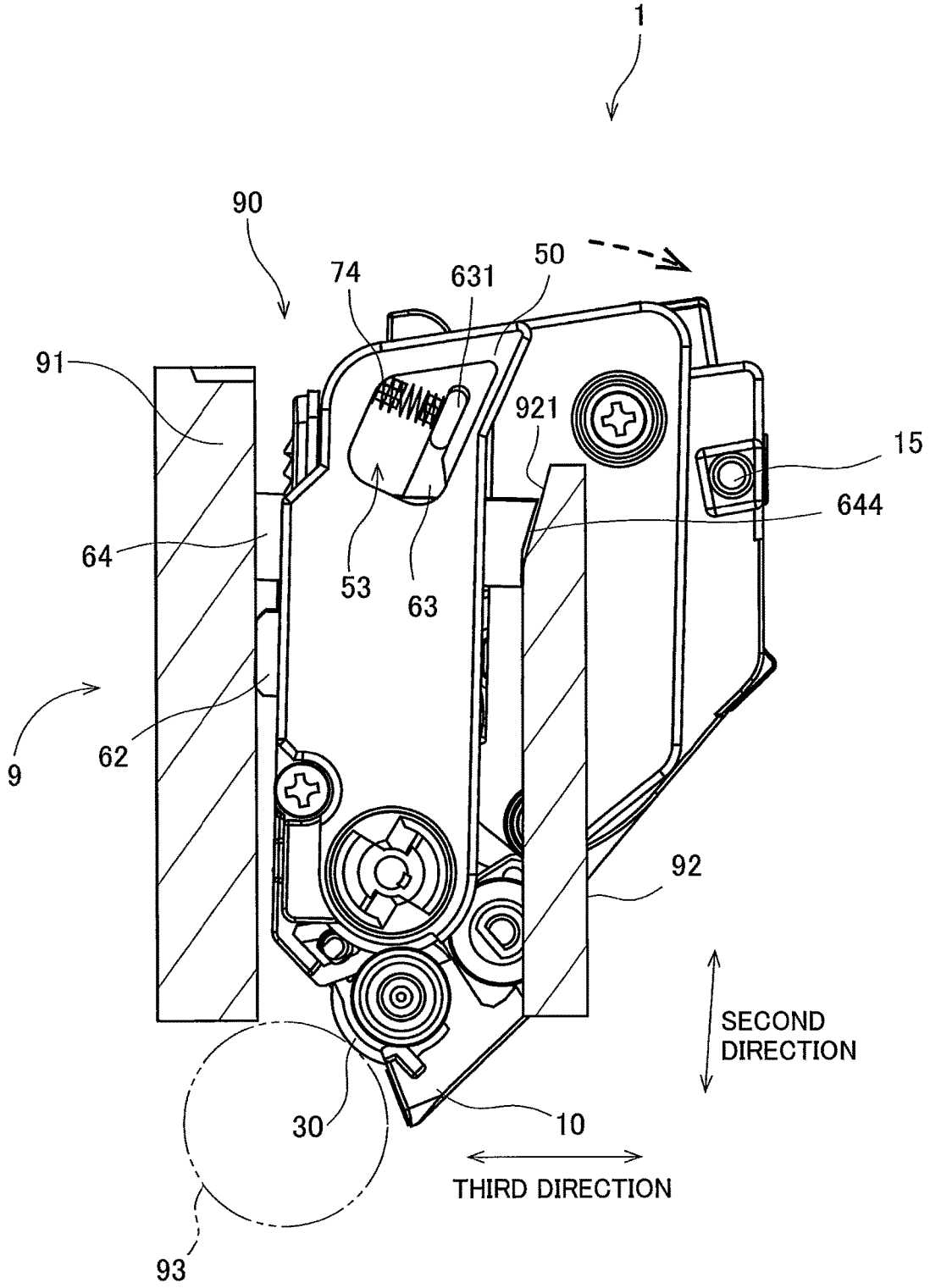
FIG. 17 is a view illustrating a state during a pivoting operation of the developing cartridge according to the fourth modification.

FIG. 17 is a view illustrating a state during the pivoting operation of the developing cartridge 1 according to the fourth modification.

After insertion of the developing cartridge 1 into the slot 90, both of the casing 10 and cover 50 pivot about the developing roller 30 in a state where the casing 10 is pressed toward the support member 64 relative to the developing roller 30. The casing 10 is inclined to the third direction as denoted by a dashed arrow in FIG. 17 relative to the slot 90 from the position at insertion of the developing cartridge 1 into the slot 90. At this time, the columnar protrusion 15 of the casing 10 contacts the pressure member (not illustrated) of the drawer unit 9. As a result, the developing roller 30 is pressed against the photosensitive drum 93. That is, the developing roller 30 and photosensitive drum 93 are kept in a contact state.

Further, in a case where both of the casing 10 and cover 50 pivot about the developing roller 30 in the pivoting operation, the length of the pressing member 74 in the third direction becomes shorter than the natural length of the pressing member 74, which causes repulsive force in the third direction in the pressing member 74. Accordingly, in a case where the boss 631 moves in the third direction, the lever 63 swings about the second axis from the first position to the second position. Accordingly, the electric contact surface of the IC chip 61 swings from the retreat position to the advance position. As a result, the electric contact surface is in contact with the terminal of the first guide plate 91.

Figure 18:
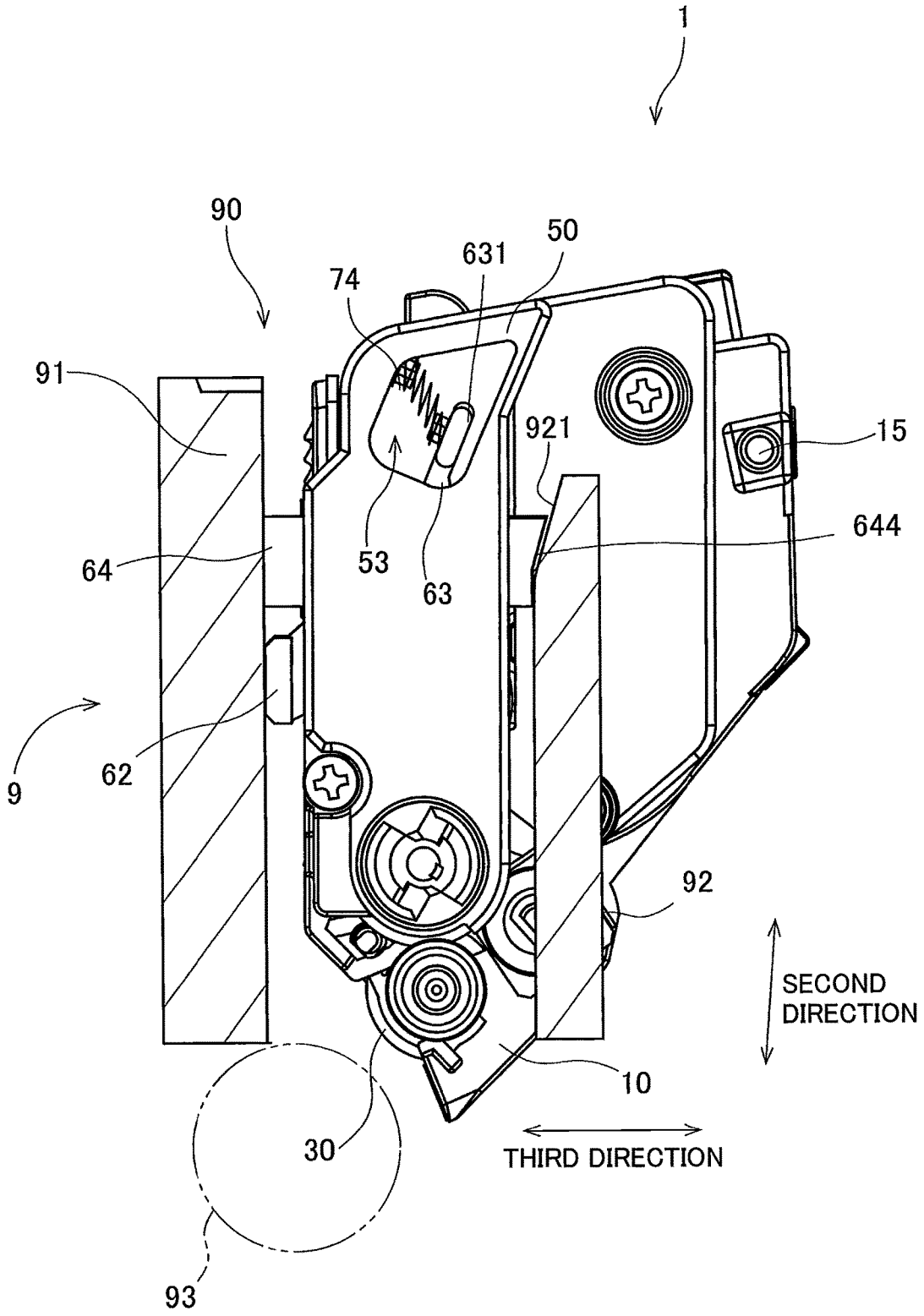
FIG. 18 is a view illustrating a state where a separating operation is performed for the developing cartridge according to the fourth modification.

FIG. 18 is a view illustrating a state where separating operation is performed for the developing cartridge 1 according to the fourth modification.

As in the explanation of FIGS. 8 and 9, during the separating operation, the casing 10, developing roller 30, and cover 50 of the developing cartridge 1 move in the second direction. As a result, the developing roller 30 and photosensitive drum 93 are separated from each other. At this time as well, the length of the pressing member 74 in the third direction is shorter than the natural length of the pressing member 74. By repulsive force of the pressing member 74 in the third direction, the electric contact surface 611 is kept in contact with the terminal of the first guide plate 91.

That is, the positions of the support member 64, lever 63, holder 62, and IC chip 61 relative to the drawer unit 9 are not changed in both the contacting state before the separating operation (state illustrated in FIG. 17) and separating state after the separating operation (state illustrated in FIG. 18). That is, the lever 63 is kept at the second position, and the electric contact surface 611 is kept at the advance position, while the casing 10, developing roller 30, and cover 50 move in the second direction relative to the drawer unit 9, support member 64, lever 63, holder 62, and IC chip 61.

<6-5. Fifth Modification>

Figure 19:
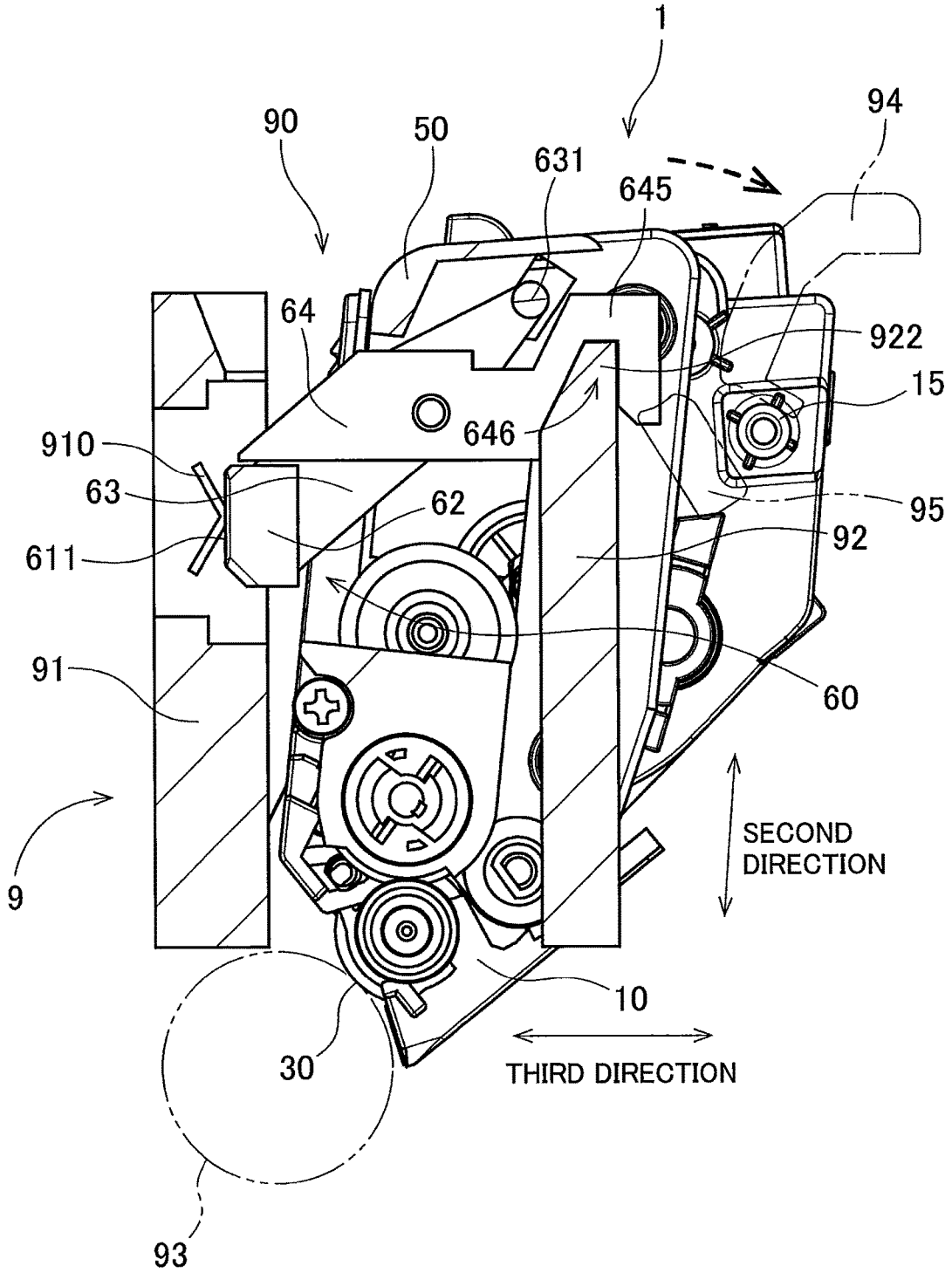
FIG. 19 is a view illustrating a state during a pivoting operation of a developing cartridge according to a fifth modification.

FIG. 19 is a view illustrating a state during the pivoting operation of the developing cartridge 1 according to a fifth modification.

In the above embodiment, the first and second slopes 643 and 644 of the support member 64 are made to contact with the first holding surface 911 and the second holding surface 921, respectively. Accordingly, the support member 64 is fixed in position relative to the drawer unit 9. The fifth modification differs from the above embodiment in the configuration for positioning the support member 64. In this example, the support member 64 includes a first engaging portion 645 in place of the first and second slopes 643 and 644.

The support member 64 includes the first engaging portion 645 configured to be fixed in position relative to the drawer unit 9. The first engaging portion 645 is positioned at an end part of the support member 64 in the third direction. The first engaging portion 645 may be realized by having a recessed portion 646 in the lower surface of the support member 64. For example, the first engaging portion 645 is a hook.

As illustrated in FIG. 19, in a case where the developing cartridge 1 is inserted in the slot 90, a leading end portion 922 of the second guide plate 92 in the second direction is inserted in the recessed portion 646. Then, the leading end portion 922 of the second guide plate 92 in the second direction and the first engaging portion 645 engage with each other. As a result, the support member 64 is fixed in position relative to the drawer unit 9 in the second and third directions. For example, in a case where the first engaging portion 645 is a hook, the hook is hooked to the leading end portion 922 of the second guide plate 92 in the second direction.

The support member 64 may include an engaging portion to be engaged with the leading end portion of the first guide plate 91 in the second direction. The engaging portion may have the same shape as that of the above-described first engaging portion 645. Further alternatively, the support member 64 may include an engaging portion to be engaged with a portion other than the first and second guide plates 91 and 92 of the drawer unit 9. In this case as well, the engaging portion may have the same shape as that of the above-described first engaging portion 645. As described above, the support member 64 may be positioned in the second and third directions by the first engaging portion to be engaged with a portion of the image forming apparatus.

<6-6. Sixth Modification>

Figure 20:
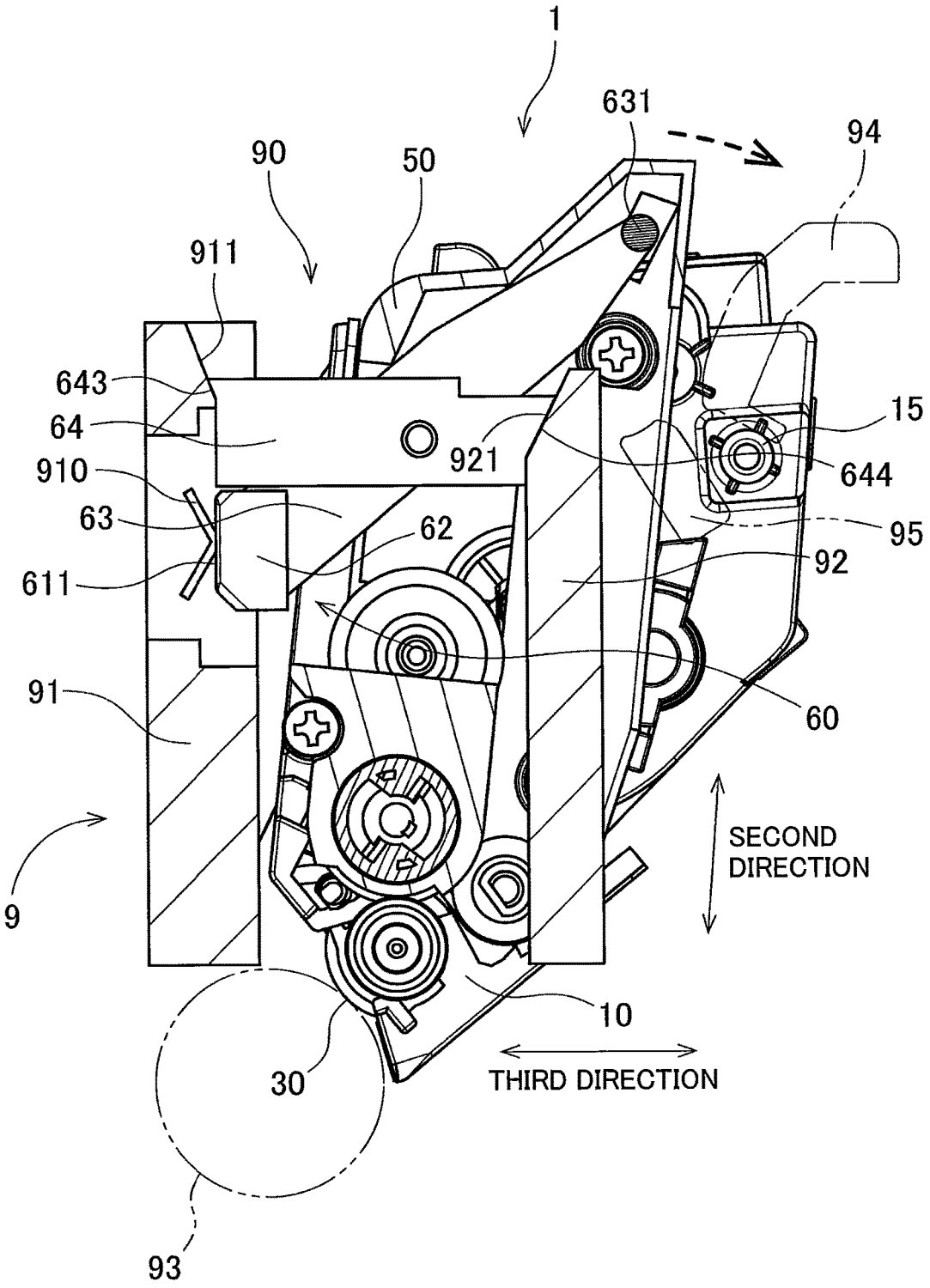
FIG. 20 is a view illustrating a state during a pivoting operation of a developing cartridge according to a sixth modification.

FIG. 20 is a view illustrating a state during the pivoting operation of the developing cartridge 1 according to a sixth modification.

The sixth modification differs from the above embodiment in the length between the second axis and the boss 631. In this example, the IC chip assembly 60 includes the lever 63 which is longer than the lever 63 of the above embodiment.

In the example of FIG. 20, in the lever 63, the length between the second axis and the boss 631 as the pressed portion is longer than the length between the second axis and the electric contact surface 611. Thus, by the pivoting operation, the electric contact surface 611 can be made to contact the terminal 910 at a higher pressure than that the boss 631 receives from the cover 50. This can make conduction between the electric contact surface 611 and the terminal 910 more stable.

<6-7. Seventh Modification>

Figure 21:
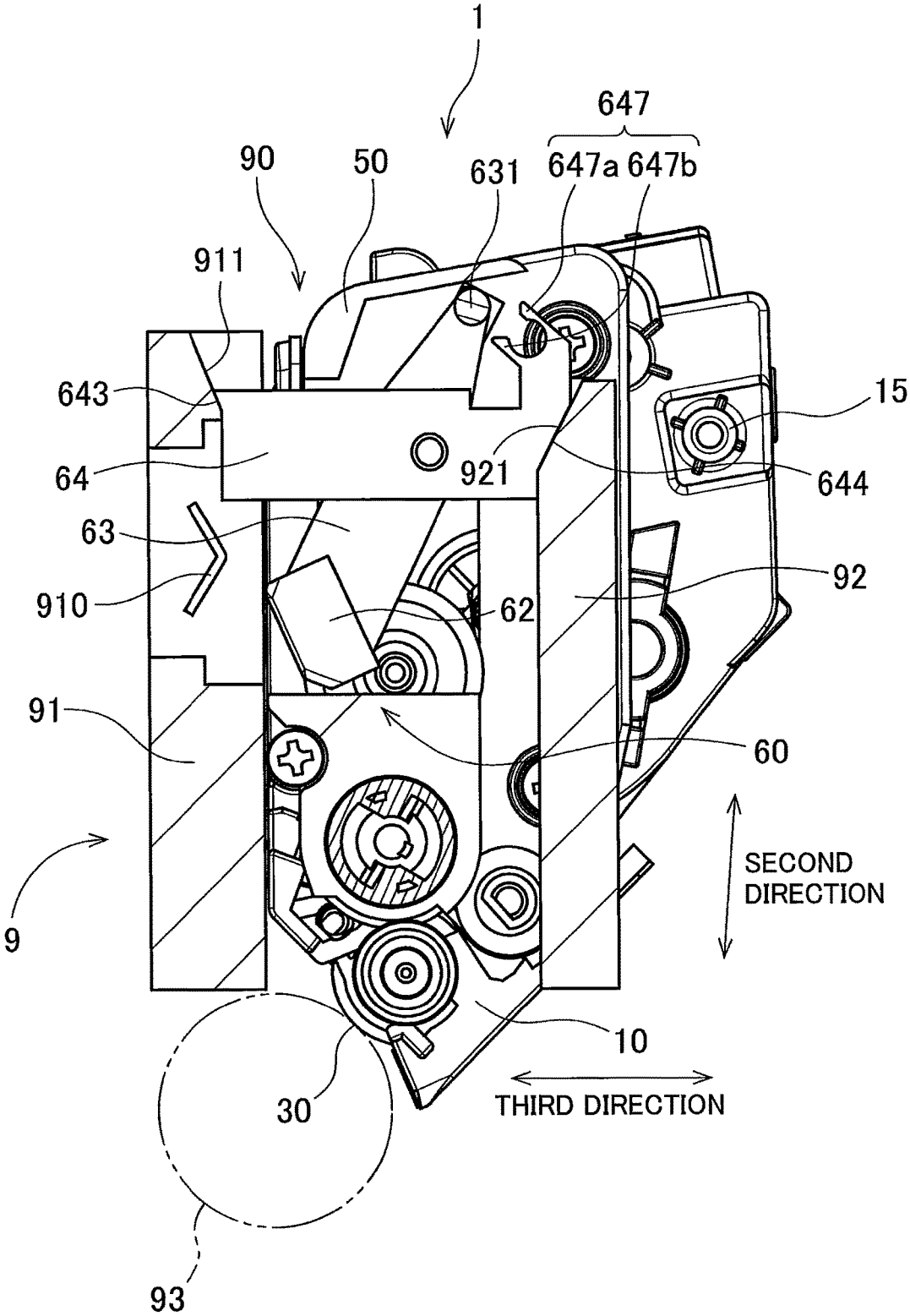
FIG. 21 is a view illustrating a state where a developing cartridge according to a seventh modification is in an inserting operation.
Figure 22:
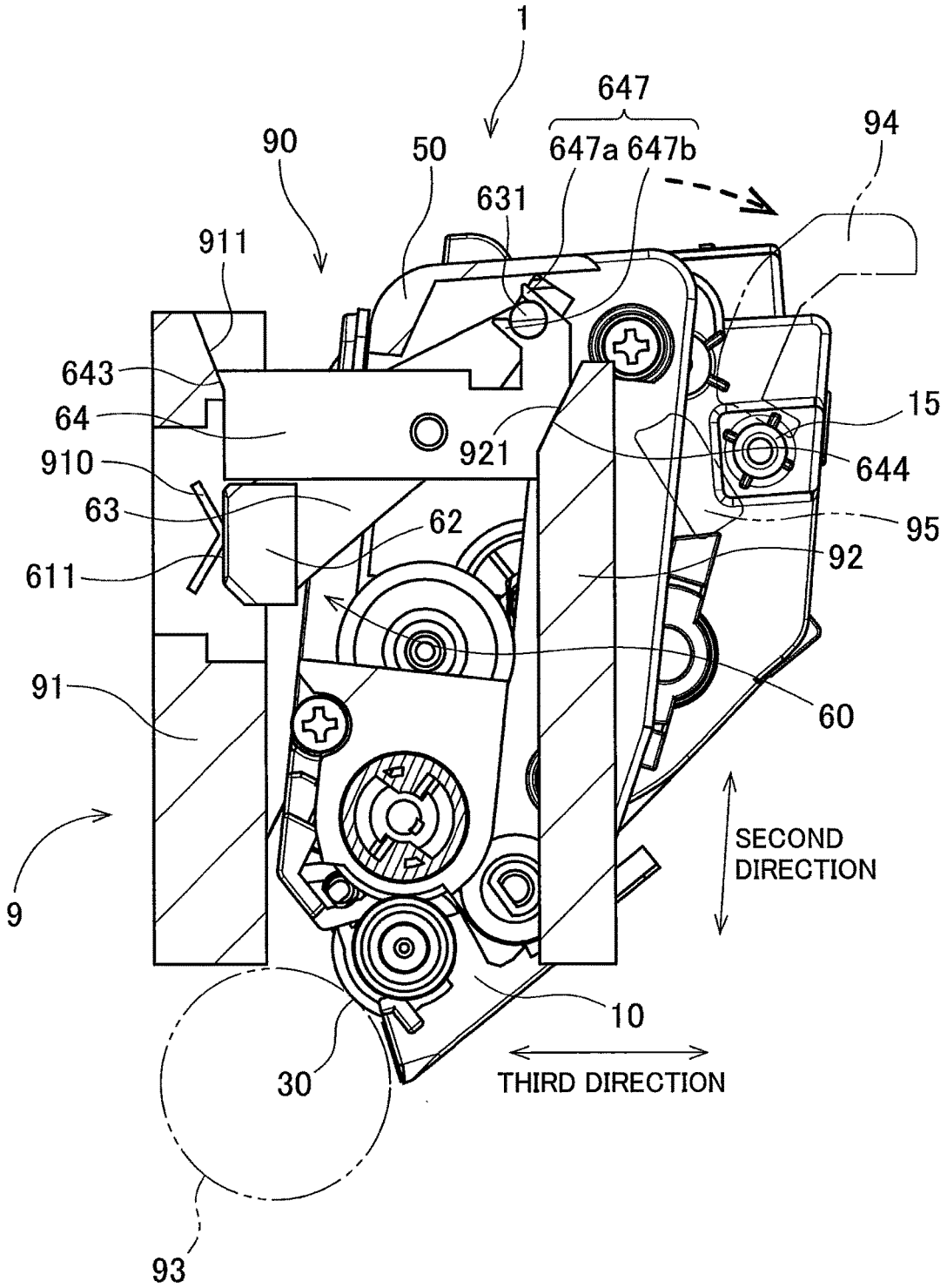
FIG. 22 is a view illustrating a state during a pivoting operation of the developing cartridge according to the seventh modification.

FIG. 21 is a view illustrating a state where the developing cartridge 1 according to a seventh modification is inserted. FIG. 22 is a view illustrating a state during the pivoting operation of the developing cartridge 1 according to the seventh modification.

The seventh modification differs from the above embodiment in the following point. That is, the lever 63 is fixed at the second position, thereby suppressing the electric contact surface 611 from being separated from the terminal 910 after the pivoting operation of the developing cartridge 1. In this example, the support member 64 includes a second engaging portion 647 in addition to the components of the developing cartridge 1 according to the above embodiment. The second engaging portion is an example of an engaging portion.

In the example illustrated in FIGS. 21 and 22, the support member 64 includes the second engaging portion 647. The second engaging portion 647 is positioned at one of the end parts of the support member 64 in the third direction that is closer to the boss 631. The second engaging portion 647 includes a first engagement pawl 647*a* and a second engagement pawl 647*b*. The first engagement pawl 647*a* and second engagement pawl 647*b* each have flexibility. The interval between the first and second engagement pawls 647*a* and 647*b* is slightly smaller than the outer diameter of the boss 631.

As illustrated in FIG. 22, during the pivoting operation, the lever 63 swings about the second axis from the first position to the second position. Accordingly, the electric contact surface 611 of the IC chip 61 swings from the retreat position to the advance position, with the result that the electric contact surface 611 contacts the terminal 910. At this time, the boss 631 moves in the third direction to be engaged with the second engaging portion 647. That is, in a case where the electric contact surface 611 is in contact with the terminal 910, the boss 631 moves in the third direction to be held by the second engaging portion 647. Specifically, the boss 631 is held between the first and second engagement pawls 647*a* and 647*b*, whereby the lever 63 is fixed at the second position. The boss 631 has a portion as an example of an engaged portion.

With this configuration, the electric contact surface 611 can be further suppressed from separating from the terminal 910 after the pivoting operation.

<6-8. Eighth Modification>

Figure 23:
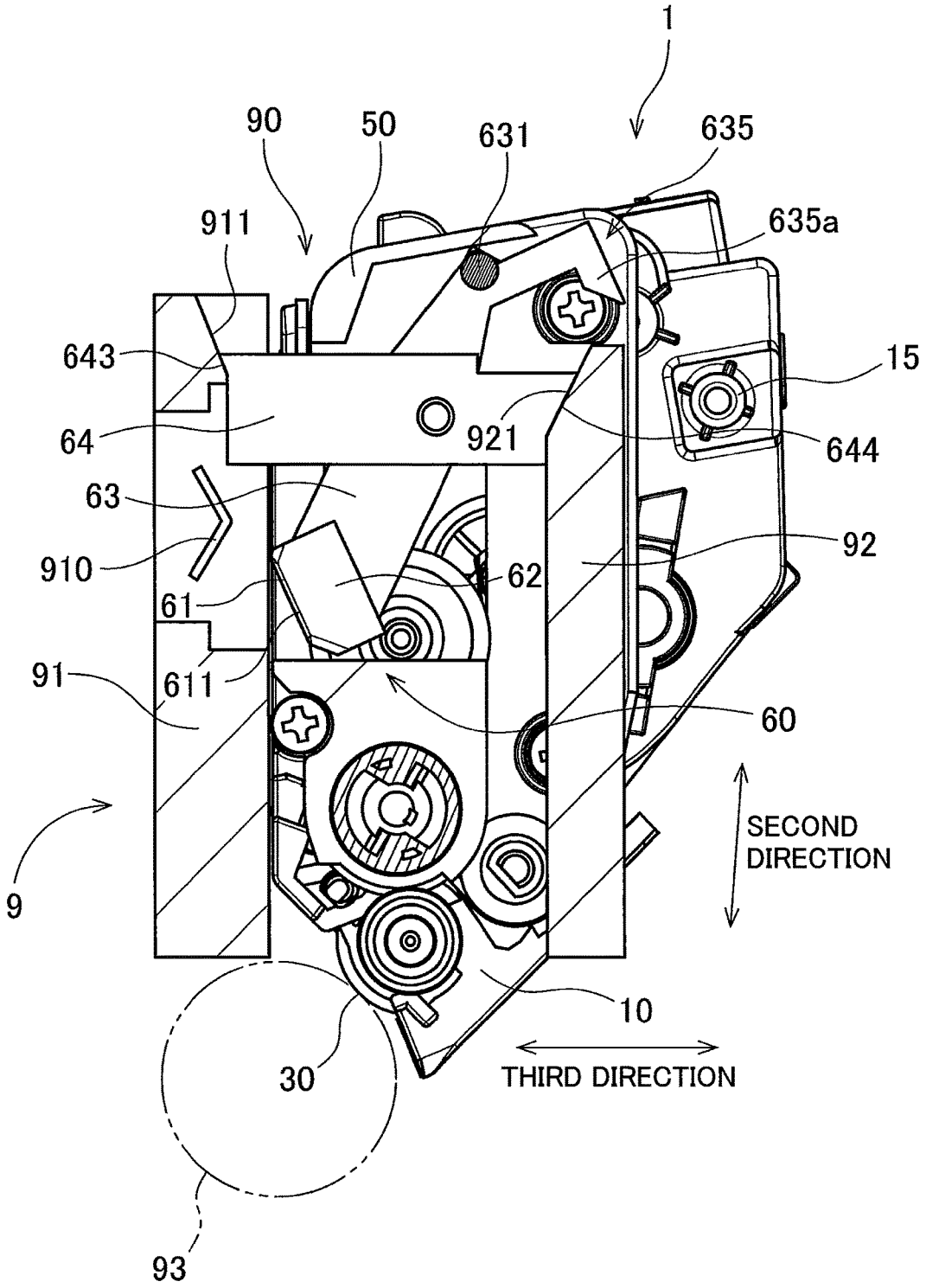
FIG. 23 is a view illustrating a state where a developing cartridge according to an eighth modification is in an inserting operation.
Figure 24:
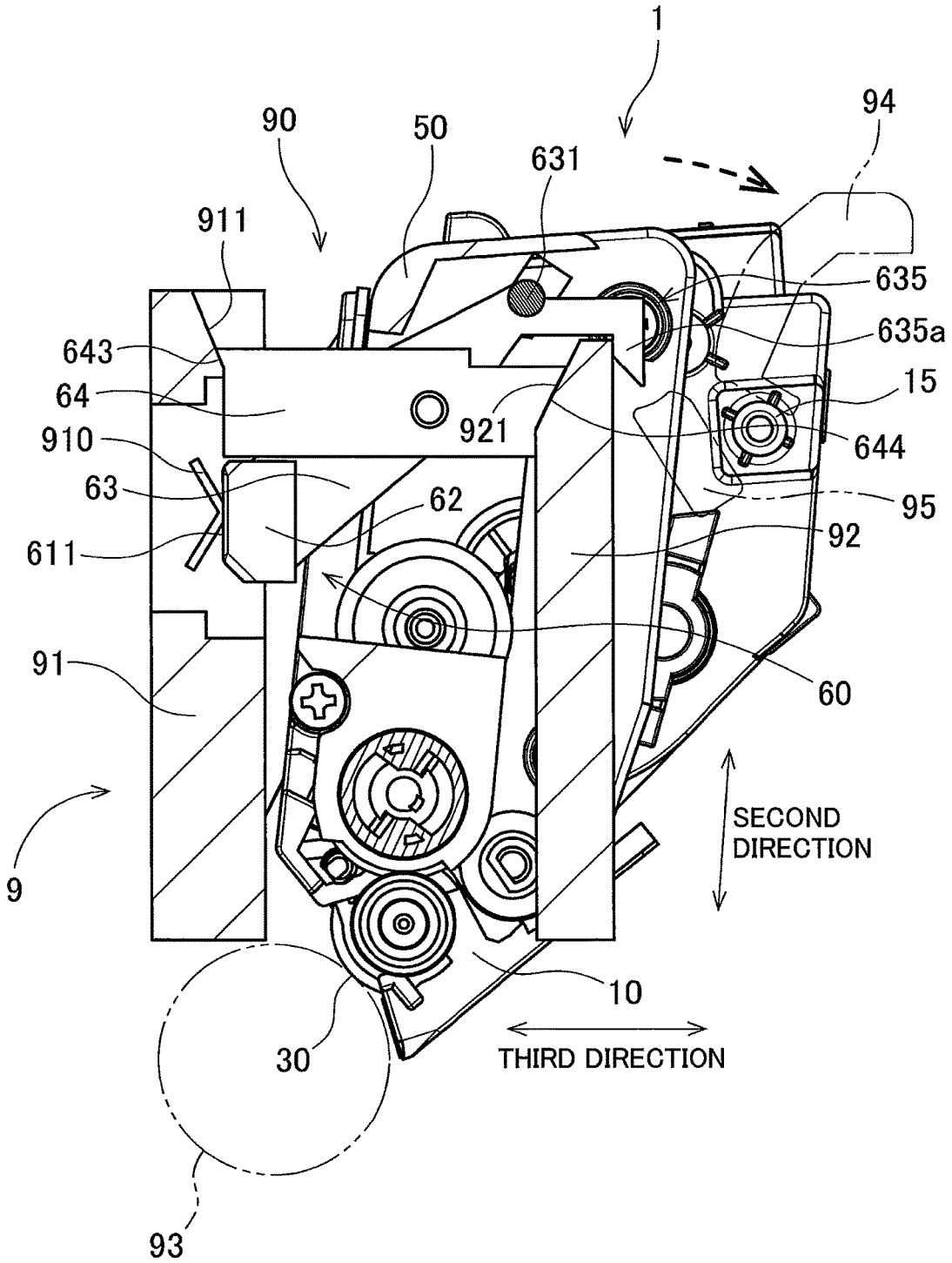
FIG. 24 is a view illustrating a state during a pivoting operation of the developing cartridge according to the eighth modification.

FIG. 23 is a view illustrating a state where the developing cartridge 1 according to an eighth modification is inserted to the drawer unit 9. FIG. 24 is a view illustrating a state during the pivoting operation of the developing cartridge 1 according to the eighth modification.

The eighth modification differs from the above embodiment in the following point. That is, the lever 63 is fixed at the second position, thereby suppressing the electric contact surface 611 from separating from the terminal 910 after the pivoting operation of the developing cartridge 1. In this example, the lever 63 includes a third engaging portion 635 in addition to the components of the developing cartridge 1 according to the above embodiment. The third engaging portion 635 is an example of an engagement portion.

In the example illustrated in FIGS. 23 and 24, the lever 63 includes the third engaging portion 635. The third engaging portion 635 is positioned at one end of the lever 63 in the second direction. The third engaging portion 635 includes an engagement pawl 635*a* extending from the one end of the lever 63 in its rotation direction about the second axis. The engagement pawl 635*a* has flexibility. As illustrated in FIG. 23, in a state where the developing cartridge 1 is inserted in the slot 90 of the drawer unit 9, the distance between the second axis and the engagement pawl 635*a* is slightly shorter than the distance between the second axis and the leading end portion of the second guide plate 92.

As illustrated in FIG. 24, during the pivoting operation, the lever 63 swings about the second axis from the first position to the second position. Accordingly, the electric contact surface 611 of the IC chip 61 swings from the retreat position to the advance position. Accordingly, the electric contact surface 611 is in contact with the terminal 910. At this time, the engagement pawl 635*a* engages with the leading end portion of the second guide plate 92. That is, the engagement pawl 635*a* is caught at the leading end portion of the second guide plate 92. Specifically, the engagement pawl 635*a* is in contact with the surface of the second guide plate 92 that is opposite surface thereof facing the first guide plate 91, whereby the lever 63 is fixed at the second position. The third engaging portion 635 may include a hook in place of the engagement pawl 635*a*. In this case, the hook hooks to the leading end portion of the second guide plate 92.

As described above, by providing the third engaging portion 635 to be engaged with a portion of the image forming apparatus at the one end portion of the lever 63, the electric contact surface 611 can be further suppressed from separating from the terminal 910 after the pivoting operation.

<6-9. Other Modifications>

In the above embodiment, the whole lever is a rigid body. However, a portion or the whole of the lever may be an elastic body. Specifically, a portion or the whole of the lever may be made from rubber or resin having elasticity. In a case where a portion or the whole of the lever is such an elastic body, the lever itself is elastically deformed. This allows the terminal 910 and electric contact surface 611 to contact with each other more stably. Further, damage to the lever due to contact with other members is less likely to occur. Further, using resin as a material for the lever facilitates the formation of a complicated shape.

Further, in the above embodiment, the IC chip including the electric contact surface is fixed to the holder outer surface. However, a configuration may be adopted, in which only the electric contact surface contacting the terminal is fixed to the holder outer surface, and portions other than the electric contact surface of the IC chip are positioned at other portions of the developing cartridge.

Further, in the above embodiment, the insertion direction of the developing cartridge relative to the drawer unit 9 coincides with the second direction. However, the insertion direction and second direction may differ from each other.

The first and second directions need not be perpendicular to each other. The second and third directions need not be perpendicular to each other. Further, the first and third directions need not be perpendicular to each other.

Further, in the above embodiment, the plurality of gears in the gear portion are engaged with each other through meshing of the gear teeth. However, the plurality of gears in the gear portion may be engaged with each other by friction force. For example, a friction member (e.g., rubber) may be used on the outer periphery of each of two gears which are engaged with each other, in place of the plurality of gear teeth.

The detailed shape of the developing cartridge may differ from that illustrated in the drawings of the present disclosure. Further, the elements exemplified in the above embodiment of modifications may be assembled appropriately in a range where consistency is maintained.

While the description has been made in detail with reference to specific embodiment(s) thereof, it would be apparent to those skilled in the art that various changes and modifications may be made therein without departing from the spirit and scope of the above described embodiment(s).

What is claimed is:

1. A developing cartridge comprising:

a housing configured to store a developing agent;

a developing roller rotatable about a first axis extending in a first direction, the developing roller positioned at one end portion of the housing in a second direction;

a lever swingable between a first position and a second position about a second axis extending in the first direction; and a storage medium swingable together with the lever in a swing direction, the storage medium including an electric contact surface crossing the swing direction, the electric contact surface being swingable between a retreat position and an advance position, the electric contact surface being positioned at the retreat position in a case where the lever is positioned at the first position, the electric contact surface being positioned at the advance position in a case where the lever is positioned at the second position;

wherein the housing is movable in the second direction relative to the lever and the electric contact surface in a case where the electric contact surface is positioned at the advance position.

2. The developing cartridge according to claim 1, wherein the lever includes the electric contact surface.

3. The developing cartridge according to claim 1, further comprising a cover covering at least a portion of the lever;

wherein the electric contact surface positioned at the advance position is farther from the cover than the electric contact surface positioned at the retreat position is from the cover.

4. The developing cartridge according to claim 1, wherein the lever is positioned at an outer surface of the housing, the outer surface being positioned at one side of the housing in the first direction; and the developing cartridge further comprising a cover attached to the outer surface and covering at least a portion of the lever, wherein the cover and the housing are movable in the second direction relative to the lever and the electric contact surface in a case where the electric contact surface is at the advance position.

5. The developing cartridge according to claim 4, wherein the lever comprises a boss extending in the first direction;

wherein the cover includes a guide surface configured to guide the boss in the second direction; and wherein the boss moves along the guide surface in the second direction in a case where the housing and the cover move in the second direction relative to the lever and the electric contact surface.

6. The developing cartridge according to claim 5, wherein the boss is positioned at one end portion of the lever; and wherein the electric contact surface is positioned at other end portion of the lever.

7. The developing cartridge according to claim 5, wherein, in a case where the housing and the cover pivot about the developing roller relative to an image forming apparatus in a state where the developing cartridge is inserted in the image forming apparatus, the guide surface presses the boss such that the lever swings from the first position to the second position.

8. The developing cartridge according to claim 4, wherein the cover includes a boss extending in the first direction;

wherein the lever includes a guide surface configured to guide the boss in the second direction; and wherein the boss moves in the second direction along the guide surface in a case where the housing and the cover move in the second direction relative to the lever and the electric contact surface.

9. The developing cartridge according to claim 8, wherein the guide surface is positioned at one end portion of the lever; and wherein the electric contact surface is positioned at other end portion of the lever.

10. The developing cartridge according to claim 8, wherein, in a case where the housing and the cover pivot about the developing roller relative to an image forming apparatus in a state where the developing cartridge is inserted in the image forming apparatus, the boss presses the guide surface such that the lever swings from the first position to the second position.

11. The developing cartridge according to claim 4, further comprising a support member positioned at the outer surface, the support member being swingably supporting the lever about the second axis, and at least a portion of the support member being covered by the cover;

wherein the housing and the cover are movable in the second direction relative to the support member, the lever, and the electric contact surface.

12. The developing cartridge according to claim 11, wherein, in a case where the developing cartridge is inserted in an image forming apparatus, the support member is positioned to the image forming apparatus.

13. The developing cartridge according to claim 12, wherein the support member extends in a third direction crossing the first direction and the second direction and the support member includes one end part and another end part in the third direction, the support member further including a pressing member configured to press the support member from the one end part to the another end part.

14. The developing cartridge according to claim 12, wherein the support member extends in a third direction crossing the first direction and the second direction, the support member further including an engaging portion at one end part of the support member in the third direction, the engaging portion configured to engage with a portion of the image forming apparatus.

15. The developing cartridge according to claim 11, wherein the support member is positioned between one end portion of the lever and other end portion of the lever.

16. The developing cartridge according to claim 11, wherein the support member extends in a third direction crossing the first direction and the second direction and the support member includes one end part and another end part in the third direction; and wherein the electric contact surface is positioned between the one end part and the another end part in the third direction in a case where the electric contact surface is positioned at the retreat position, and wherein the electric contact surface is positioned farther from the another end part than from the one end part in the third direction in a case where the electric contact surface is positioned at the advance position.

17. The developing cartridge according to claim 1, wherein the lever is positioned at an outer surface of the housing, the outer surface being positioned at one side of the housing in the first direction; and the developing cartridge further comprising a support member positioned at the outer surface, the support member swingably supporting the lever about the second axis and being movable together with the lever and the electric contact surface in the second direction relative to the housing.

18. The developing cartridge according to claim 17, wherein, in a case where the developing cartridge is inserted in an image forming apparatus, the support member is positioned to the image forming apparatus.

19. The developing cartridge according to claim 18, wherein the support member is positioned between one end portion of the lever and other end portion of the lever.

20. The developing cartridge according to claim 17, wherein the support member includes an engaging portion; and wherein the lever includes one end portion and another end portion, the lever comprising:

the electric contact surface positioned at the another end portion; and an engaged portion positioned at the one end portion and configured to engage with the engaging portion in a case where the electric contact surface is positioned at the advance position, the engaged portion disengaging from the engaging portion in a case where the electric contact surface is positioned at the retreat position.

21. The developing cartridge according to claim 1, further comprising a cover covering at least a portion of the lever;

wherein the lever includes a pressed portion configured to be pressed by one of the housing and a member fixed to the housing in a case where the housing and the cover pivot about the developing roller relative to an image forming apparatus in a state where the developing cartridge is inserted in the image forming apparatus; and wherein a length from the second axis to the electric contact surface is longer than a length from the second axis to the pressed portion.

22. The developing cartridge according to claim 1, further comprising a cover covering at least a portion of the lever;

wherein the lever includes a pressed portion configured to be pressed by one of the housing and a member fixed to the housing in a case where the housing and the cover pivot about the developing roller relative to an image forming apparatus in a state where the developing cartridge is inserted in the image forming apparatus; and wherein a length from the second axis to the pressed portion is longer than a length from the second axis to the electric contact surface.

23. The developing cartridge according to claim 1, wherein the lever includes one end portion and another end portion, the lever comprising:

the electric contact surface positioned at the another end portion; and an engaging portion positioned at the one end portion and configured to engage with a portion of an image forming apparatus in a case where the developing cartridge is inserted in the image forming apparatus.

24. The developing cartridge according to claim 1, wherein the storage medium is swingable together with the electric contact surface.

25. The developing cartridge according to claim 1 wherein the housing is movable in the second direction relative to the lever and the electric contact surface while the electric contact surface is maintained at the advance position.

* * * * *